US009156535B2

(12) United States Patent
Mizutani

(10) Patent No.: US 9,156,535 B2
(45) Date of Patent: Oct. 13, 2015

(54) VESSEL PROPULSION SYSTEM AND VESSEL INCLUDING THE SAME

(71) Applicant: YAMAHA HATSUDOKI KABUSHIKI KAISHA, Iwata-shi, Shizuoka (JP)

(72) Inventor: Makoto Mizutani, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 14/477,900

(22) Filed: Sep. 5, 2014

(65) Prior Publication Data

US 2015/0072575 A1 Mar. 12, 2015

(30) Foreign Application Priority Data

Sep. 12, 2013 (JP) ..... 2013-189495

(51) Int. Cl.

| | |
|---|---|
| ***B63H 5/20*** | (2006.01) |
| ***B63H 20/16*** | (2006.01) |
| ***B63H 20/12*** | (2006.01) |
| ***B63H 25/42*** | (2006.01) |
| *B63H 20/00* | (2006.01) |

(52) U.S. Cl.

CPC ..... *B63H 20/16* (2013.01); *B63H 20/12* (2013.01); *B63H 25/42* (2013.01); *B63H 2020/003* (2013.01)

(58) Field of Classification Search

USPC ..... 440/1, 53; 701/21; 114/144 R
IPC ..... B63H 20/12
See application file for complete search history.

(56) References Cited

U.S. PATENT DOCUMENTS

| | | | | |
|---|---|---|---|---|
| 2005/0092225 | A1* | 5/2005 | Kaji et al. | 114/144 R |
| 2010/0145558 | A1* | 6/2010 | Kaji | 701/21 |
| 2011/0166724 | A1* | 7/2011 | Hiramatsu | 701/21 |

FOREIGN PATENT DOCUMENTS

JP 02-179597 A 7/1990

* cited by examiner

*Primary Examiner* — Stephen Avila
(74) *Attorney, Agent, or Firm* — Keating & Bennett, LLP

(57) ABSTRACT

A vessel propulsion system includes propulsion apparatuses that are turnably mounted on a stern of a hull in an inclined manner such that a turning center line intersects a hull center line, turning actuators that respectively turn the propulsion apparatuses left and right with respect to the hull, a steering device that outputs a steering command, and a control unit that controls the turning actuators individually according to the steering command. The control unit includes a storage unit that stores a reference angle that the turning center line of each propulsion apparatus defines with respect to the hull center line, and a turning command angle computing unit that determines a turning command angle of each propulsion apparatus. The control unit drives each turning actuator based on each turning command angle.

20 Claims, 22 Drawing Sheets

VESSEL PROPULSION SYSTEM AND VESSEL INCLUDING THE SAME

BACKGROUND OF THE INVENTION

1. Field of the Invention

The present invention relates to a vessel propulsion system including a plurality of propulsion apparatuses to be turnably mounted on a stern of a hull and a vessel including such a vessel propulsion system.

2. Description of the Related Art

Japanese Patent Application Publication No. 02-179597 discloses a vessel having two outboard motors provided in parallel on a transom portion of the hull. Lateral portions of the transom portion are inclined toward the outside of the hull, and the outboard motors are mounted on the lateral portions via transom boards. In the transom portion of the hull, a link mechanism including a differential lever is arranged. Steering arms of the two outboard motors are coupled to the link mechanism. To the differential lever, an operating force of a steering wheel is transmitted via a steering cable. Thus, when the steering wheel is operated, its operating force is transmitted to the two outboard motors via the link mechanism, and the two outboard motors mechanically interlock to turn. Accordingly, the hull turns according to an operating direction of the steering wheel. As a result of the lateral portions being inclined toward the outside of the hull, the outboard motor arranged on the inner side with respect to the turning direction is increased in turning angle, and turning performance is thereby improved.

SUMMARY OF THE INVENTION

The inventor of preferred embodiments of the present invention described and claimed in the present application conducted an extensive study and research regarding vessel propulsion systems, such as the one described above, and in doing so, discovered and first recognized new unique challenges and previously unrecognized possibilities for improvements as described in greater detail below.

Recently, there has been proposed a vessel propulsion system in which an electric turning mechanism that controls the turning angle by a drive force of a turning actuator is provided for each of a plurality of propulsion apparatuses, and which is capable of individually setting the turning angles of the respective propulsion apparatuses. In such a vessel propulsion system, because the turning angle of each propulsion apparatus is capable of being set independently of another propulsion apparatus, a turning pattern of the plurality of propulsion apparatuses is capable of being set in various ways. Hull behavior that is impractical in an configuration in which the turning angles of a plurality of propulsion apparatuses are mechanically linked are thus realized. Thus, in such an configuration, practical hull behavior is considerably limited if the link mechanism as in Japanese Patent Application Publication No. 02-179597 is adopted.

A preferred embodiment of the present invention provides a vessel propulsion system which achieves both a wide variety of hull behavior and an improvement in turning performance, and a vessel including the same.

A preferred embodiment of the present invention provides a vessel propulsion system including a plurality of propulsion apparatuses that are turnably mounted on a stern of a hull in an inclined manner such that a turning center line intersects a hull center line, a plurality of turning actuators that respectively turn the plurality of propulsion apparatuses left and right with respect to the hull, a steering device that outputs a steering command, and a control unit that is configured or programmed to control the plurality of turning actuators individually according to the steering command output by the steering device. The control unit includes a storage unit that stores a reference angle that the turning center line of each propulsion apparatus defines with respect to the hull center line, and a turning command angle computing unit that is configured or programmed to determine a turning command angle of each propulsion apparatus. The control unit is configured or programmed to drive the corresponding turning actuator based on each turning command angle. The turning command angle computing unit is configured or programmed to determine the turning command angle of each propulsion apparatus based on the steering command output by the steering device and the reference angle of each propulsion apparatus stored in the storage unit.

According to this configuration, the plurality of propulsion apparatuses are mounted on the stern of the hull in an inclined manner such that the turning center line intersects the hull center line. Thus, the turning angle of the propulsion apparatus is capable of having a greater value than that when the turning center line is parallel or substantially parallel to the hull center line. The turning performance of the hull is thus improved. On the other hand, the plurality of propulsion apparatuses do not mechanically interlock with each other, but each propulsion apparatus is turned independently of another propulsion apparatus via the individual turning actuators. A wide variety of hull behavior is thus achieved.

The control unit has stored therein the reference angle that the turning center line of each propulsion apparatus defines with respect to the hull center line in the storage unit. The control unit is configured or programmed to use the reference angle to determine an appropriate turning command angle of each propulsion apparatus according to the steering command. Thus, as a result of the turning actuator being driven using the turning command angle, a thrust in an appropriate direction preferably is generated from each propulsion apparatus despite the propulsion apparatus being mounted on the stern of the hull in the inclined manner.

The hull center line is a line that divides the hull into two equal or substantially equal left and right portions in a plan view. The turning angle of the propulsion apparatus may also be defined by an angle between the direction of a thrust generated by the propulsion apparatus and a direction parallel or substantially parallel to the hull center line. When a turning neutral position is set and an angle of deviation to the left and right thereof is denoted by a positive or negative sign to express a turning angle, the magnitude of the turning angle is expressed by its absolute value. The turning center line is a line that divides the entire turning angle range of the propulsion apparatus into two equal or substantially equal portions in a plan view. The turning direction is defined by the moving direction of the propulsion apparatus when it is turned. It can also be said that the turning direction is defined by the direction in which the action line of a thrust generated by the propulsion apparatus moves in the rear of the propulsion apparatus.

In a preferred embodiment of the present invention, the turning command angle computing unit is configured or programmed to take a turning position of each propulsion apparatus a thrust of which is along a direction parallel or substantially parallel to the hull center line as a turning neutral position of the propulsion apparatus, and compute the turning command angle of each propulsion apparatus mounted on the stern in the inclined manner such that characteristics in response to the steering command output by the steering device are different between left and right of the turning neutral position.

According to this configuration, the turning command angle of the propulsion apparatus mounted on the stern in the inclined manner is determined with the turning position of the propulsion apparatus when the thrust is along the direction parallel or substantially parallel to the hull center line taken as the turning neutral position. Moreover, the turning command angle of the propulsion apparatus mounted in the inclined manner is computed such that characteristics in response to the steering command are different between the left and right of the turning neutral position. Accordingly, turning angle control of the propulsion apparatus mounted in the inclined manner is appropriately performed. Both a wide variety of hull behavior and an improvement in turning performance are thus achieved.

In a preferred embodiment of the present invention, the turning command angle computing unit is configured or programmed to compute the turning command angle of each propulsion apparatus mounted on the stern in the inclined manner such that a turning amount in response to the steering command output by the steering device is different between left and right of the turning neutral position.

According to this configuration, for the propulsion apparatus mounted in the inclined manner, the turning command angle is computed such that the turning amounts in response to the steering command are different between the left and right of the turning neutral position, so that an appropriate turning command angle is set within the limited entire turning angle range. Both a wide variety of hull behavior and an improvement in turning performance are thus achieved.

In a preferred embodiment of the present invention, the turning command angle computing unit is configured or programmed to compute the turning command angle of each propulsion apparatus mounted on the stern in the inclined manner such that a rate of change in a turning amount in response to the steering command output by the steering device is different between left and right of the turning neutral position.

According to this configuration, for the propulsion apparatus mounted in the inclined manner, the turning command angle is computed such that the rate of change in the turning amount in response to the steering command are different between the left and right of the turning neutral position, so that an appropriate turning command angle is set within the limited entire turning angle range. Both a wide variety of hull behavior and an improvement in turning performance are thus achieved.

In a preferred embodiment of the present invention, the turning command angle computing unit is configured or programmed to compute the turning command angle of each propulsion apparatus mounted on the stern in the inclined manner such that a maximum right turning command angle that is the maximum turning command angle in a right direction from the turning neutral position and a maximum left turning command angle that is the maximum turning command angle in a left direction from the turning neutral position are different.

The maximum right turning angle and the maximum left turning angle of the propulsion apparatus mounted in the inclined manner are different because of physical turning limitations. Therefore, by computing the turning command angle accordingly such that the maximum right turning command angle and the maximum left turning command angle are different, appropriate turning angle control is capable of being performed. Both a wide variety of hull behavior and an improvement in turning performance are thus achieved.

In a preferred embodiment of the present invention, when a turning angle of each propulsion apparatus has reached an upper limit turning angle in one direction, the turning command angle computing unit is configured or programmed to keep the turning command angle of the propulsion apparatus unchanged even if the steering device outputs the steering command for further steering in the one direction.

According to this configuration, the turning command angle is set in a range not more than the upper limit turning angle. When the turning angle has reached the upper limit turning angle, the upper limit turning angle is taken as the turning command angle for further steering command. Because appropriate turning angle control is thus performed, both a wide variety of hull behavior and an improvement in turning performance are achieved.

The upper limit turning angle is an upper limit value of the turning angle determined in a range not more than the maximum turning angle. The maximum turning angle is the physical maximum value of the turning value of the propulsion apparatus. More specifically, the maximum turning angle is the maximum value of the turning angle within the entire turning angle range in which the propulsion apparatus is capable of being turned without interference with the hull and other structures. The propulsion apparatus mounted on the hull in the inclined manner is different in the maximum turning angle between the right side and left side of the turning neutral position. Upper limit turning angles different between the right side and left side of the turning neutral position preferably is set accordingly.

In a preferred embodiment of the present invention, the steering device includes an operating member that is operated left and right by an operator. The turning command angle computing unit is configured or programmed to keep the turning command angle of the propulsion apparatus unchanged when an operation amount in one direction of the operating member is not less than a predetermined operation amount corresponding to the upper limit turning angle of each propulsion apparatus.

According to this configuration, when the operation amount in one direction of the operating member becomes not less than a value corresponding to the upper limit turning angle, the turning command angle no longer changes. Accordingly, an appropriate turning command angle is preferably set by control based on the operation amount of the operating member. Because appropriate turning angle control is thus performed, both a wide variety of hull behavior and an improvement in turning performance are achieved.

The steering device may include an operating member that is configured to be operated by equal or substantially equal operation amounts to the left and right from an operating neutral position. That is, the operation amounts to the left and right may be limited to certain values equal or substantially equal to each other.

In a preferred embodiment of the present invention, the steering device includes an operating member arranged to be able to be operated unlimitedly left and right. When an operation amount in one direction of the operating member becomes not less than a first operation amount, the turning command angle computing unit is configured or programmed to keep a turning command angle of a first propulsion apparatus of the plurality of propulsion apparatuses unchanged. When the operation amount in one direction of the operating member becomes not less than a second operation amount greater than the first operation amount, the turning command angle computing unit is configured or programmed to keep a turning command angle of a second propulsion apparatus arranged on an inner side in terms of a turning direction of the hull than the first propulsion apparatus of the plurality of propulsion apparatuses unchanged.

In this configuration, the operating member preferably is operated unlimitedly to the left and right. In the case where the operating member is gradually operated in one direction, when its operation amount has reached the first operation amount, the turning command angle of the first propulsion apparatus disposed on the outer side with respect to the turning direction of the hull is kept unchanged even if the operation amount becomes not less than the first operation amount. On the other hand, the turning command angle of the second propulsion apparatus disposed on the inner side with respect to the turning direction of the hull changes up to the second operation amount greater than the first operation amount, and when the operation amount has reached the second operation amount, the turning command angle of the second propulsion apparatus is kept unchanged even if the operation amount becomes not less than the second operation amount. In this manner, the turning command angles of the first and second propulsion apparatuses disposed on the outer side and inner side with respect to the turning direction of the hull are appropriately controlled, by control based on the operation amount of the operating member, according to their respective mounting angles. As mentioned above, appropriate turning angle control is performed, so that both a wide variety of hull behavior and an improvement in turning performance are achieved.

In a preferred embodiment of the present invention, when a turning angle of each propulsion apparatus has reached an upper limit turning angle in one direction, the control unit is configured or programmed to stop energy supply to the corresponding turning actuator, and continues energy supply to the turning actuator stopped even if the steering device outputs the steering command for further steering in the one direction.

According to this configuration, when the turning angle of the propulsion apparatus has reached the upper limit turning angle, energy supply to the corresponding turning actuator is stopped, and the turning angle is thus maintained at a certain value. Accordingly, a wasteful energy supply is avoided, and appropriate turning control of the propulsion apparatus mounted in the inclined manner on the stern is performed.

In a preferred embodiment of the present invention, the steering device includes an operating member that is operated left and right by an operator. When an operation amount in one direction of the operating member is not less than a predetermined operation amount corresponding to the upper limit turning angle of each propulsion apparatus, the control unit is configured or programmed to stop energy supply to the turning actuator corresponding to the propulsion apparatus.

According to this configuration, energy supply to the turning actuator preferably is stopped based on the operation amount of the operating member.

In a preferred embodiment of the present invention, the steering device includes an operating member configured to be able to be operated unlimitedly left and right. When an operation amount in one direction of the operating member becomes not less than a first operation amount, the control unit is configured or programmed to stop energy supply to the turning actuator corresponding to a first propulsion apparatus of the plurality of propulsion apparatuses. When the operation amount in one direction of the operating member becomes not less than a second operation amount greater than the first operation amount, the control unit is configured or programmed to stop energy supply to the turning actuator corresponding to a second propulsion apparatus disposed on an inner side in terms of a turning direction of the hull than the first propulsion apparatus of the plurality of propulsion apparatuses.

According to this configuration, the turning angles of the first propulsion apparatus and the second propulsion apparatus respectively mounted on the outer side and inner side with respect to the turning direction of the hull are maintained at certain values, according to the operation amount of the operating member, by stopping energy supply to the corresponding turning actuator. Accordingly, appropriate turning control of the first propulsion apparatus and the second propulsion apparatus is performed, by control based on the operation amount of the operating member, according to the mounting angles of these propulsion apparatuses with respect to the hull. Both a wide variety of hull behavior and an improvement in turning performance are thus achieved.

The vessel propulsion system according to a preferred embodiment of the present invention further includes an upper limit turning angle setting unit configured or programmed to variably sets the upper limit turning angle according to a vessel state. According to this configuration, because the upper limit turning angle is variably set according to the vessel state, more appropriate turning angle control is achieved.

Examples of the vessel state may include the output of a driving source of the propulsion apparatus and the vessel speed. When the driving source of the propulsion apparatus is an engine (internal combustion engine), the output of the driving source may be the engine speed. When the driving source of the propulsion apparatus is an electric motor, the output of the driving source may be the motor rotation speed.

The vessel propulsion system according to a preferred embodiment of the present invention further includes an operation amount threshold setting unit configured or programmed to variably set the first operation amount according to a vessel state. According to this configuration, the first operation amount that is to define the upper limit turning angle of the first propulsion apparatus that is disposed on the outer side with respect to the turning direction of the hull is variably set according to the vessel state. Accordingly, variable setting of the upper limit turning value according to the vessel state is enabled by control based on the operation amount of the operating member.

In a preferred embodiment of the present invention, the turning command angle computing unit is configured or programmed to determine the turning command angle of each propulsion apparatus using a turning command angle map according to the reference angle of the propulsion apparatus, and the storage unit has stored the turning command angle map in which the reference angle is intrinsically present. According to this configuration, the turning command angle of the propulsion apparatus is determined based on the turning command angle map. The turning command angle map includes turning angle control information according to the reference angle of each propulsion apparatus to thereby have turning angle control information containing the reference angle. In this manner, the reference angle is indirectly stored by storing the turning command angle map containing the reference angle, and by making reference to the turning command angle map, turning angle control of the propulsion apparatus mounted in the inclined manner is appropriately performed. Both a wide variety of hull behavior and an improvement in turning performance are thus achieved.

In a preferred embodiment of the present invention, when the steering device outputs a neutral steering command representing a neutral position, the turning command angle computing unit is configured or programmed to determine the turning command angle of each propulsion apparatus such that each propulsion apparatus becomes parallel or substantially parallel relative to the hull center line.

According to this configuration, when the steering device outputs the neutral steering command, the direction of each propulsion apparatus (thrust direction) becomes parallel or substantially parallel to the hull center line. Thus, even if the mounting angle with respect to the stern is inclined, when making the hull travel straight, the propulsion apparatus is controlled to be at a turning position that receives less resistance from water. Accordingly, the hull is made to travel straight in a state of less energy loss. Both a wide variety of hull behavior and an improvement in turning performance are thus achieved.

The thrust direction of the propulsion apparatus may not become completely parallel to the hull center line in response to the neutral steering command. Specifically, there is a case where the action lines of thrusts of a plurality of propulsion apparatuses intersect each other so as to define a so-called toe angle. In this case, the direction of the plurality of propulsion apparatuses is controlled, in response to the neutral steering command, in a direction inclined by the toe angle. Such a case is also included in the case of being "substantially parallel to the hull center line."

In a preferred embodiment of the present invention, the plurality of propulsion apparatuses that are mounted on the stern in the inclined manner include a right propulsion apparatus that is disposed on a right side with respect to the hull center line, and mounted on the stern in an inclined manner such that a turning center line intersects the hull center line from the right side, and a left propulsion apparatus that is disposed on a left side with respect to the hull center line, and mounted on the stern in an inclined manner such that a turning center line intersects the hull center line from the left side.

According to this configuration, the right propulsion apparatus and the left propulsion apparatus disposed in a manner allocated to the left and right with respect to the hull center line are provided. Moreover, the right propulsion apparatus is mounted on the stern in an inclined posture in which the turning center line thereof intersects the hull center line from the right side. In contrast, the left propulsion apparatus is mounted on the stern in an inclined posture in which the turning center line thereof intersects the hull center line from the left side. Accordingly, when the hull turns, the propulsion apparatus positioned on the inner side with respect to the turning direction of the hull has a great turning angle in a turning direction corresponding to the turning direction of the hull, and as a result, applies a great moment in the hull turning direction to the hull. The turning performance of the hull is thus improved. Furthermore, because the right propulsion apparatus and the left propulsion apparatus are individually controlled in turning, a wide variety of hull behavior is achieved as well.

A vessel propulsion system according to a preferred embodiment of the present invention further includes a central propulsion apparatus that is disposed between the right propulsion apparatus and the left propulsion apparatus, and mounted on the stern of the hull with a turning center line in parallel or substantially in parallel with the hull center line.

In this configuration, the central propulsion apparatus is provided between the left and right propulsion apparatuses, and the turning center line of the central propulsion apparatus is parallel or substantially parallel with the hull center line. That is, the central propulsion apparatus has a reference angle of zero or substantially zero. Therefore, regarding the central propulsion apparatus, upper limit turning angles that are equal or substantially equal in the left and right direction preferably are set. Providing the central propulsion apparatus achieves a wider variety of hull behavior.

Either only one central propulsion apparatus or two or more central propulsion apparatuses may be provided, for example.

In a preferred embodiment of the present invention, according to the steering command output by the steering device, the turning command angle computing unit is configured or programmed to determine a turning command angle of the central propulsion apparatus without performing correction according to a leftward or rightward mounting angle of the central propulsion apparatus with respect to the stern of the hull.

Because the central propulsion apparatus has a leftward or rightward mounting angle of zero or substantially zero, correction according to the leftward or rightward mounting angle is unnecessary. The leftward or rightward mounting angle is an angle that the hull center line and the turning center line define in a plan view, that is, the reference angle.

In a preferred embodiment of the present invention, each propulsion apparatus is an outboard motor including a front portion opposed to the stern and a wide portion that is disposed farther to the rear than the front portion and wider than the front portion.

According to this configuration, the outboard motor defining and serving as a propulsion apparatus has the wide portion at a position further to the rear than its front portion. In such an configuration, there is a possibility that the wide portions of the plurality of outboard motors interfere with each other and the respective outboard motors are limited in their turning angle ranges. Therefore, by mounting the outboard motors in inclined postures with respect to the stern and individually controlling the respective outboard motors in turning angle, the limitation in the turning angle ranges of the respective outboard motors is reduced. The turning performance of the hull is thus improved, and a wide variety of hull behavior is achieved.

A preferred embodiment of the present invention provides a vessel including a hull, and the above-described vessel propulsion system equipped on the hull. This configuration provides a vessel improved in turning performance without sacrificing a wide variety of vessel behavior.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
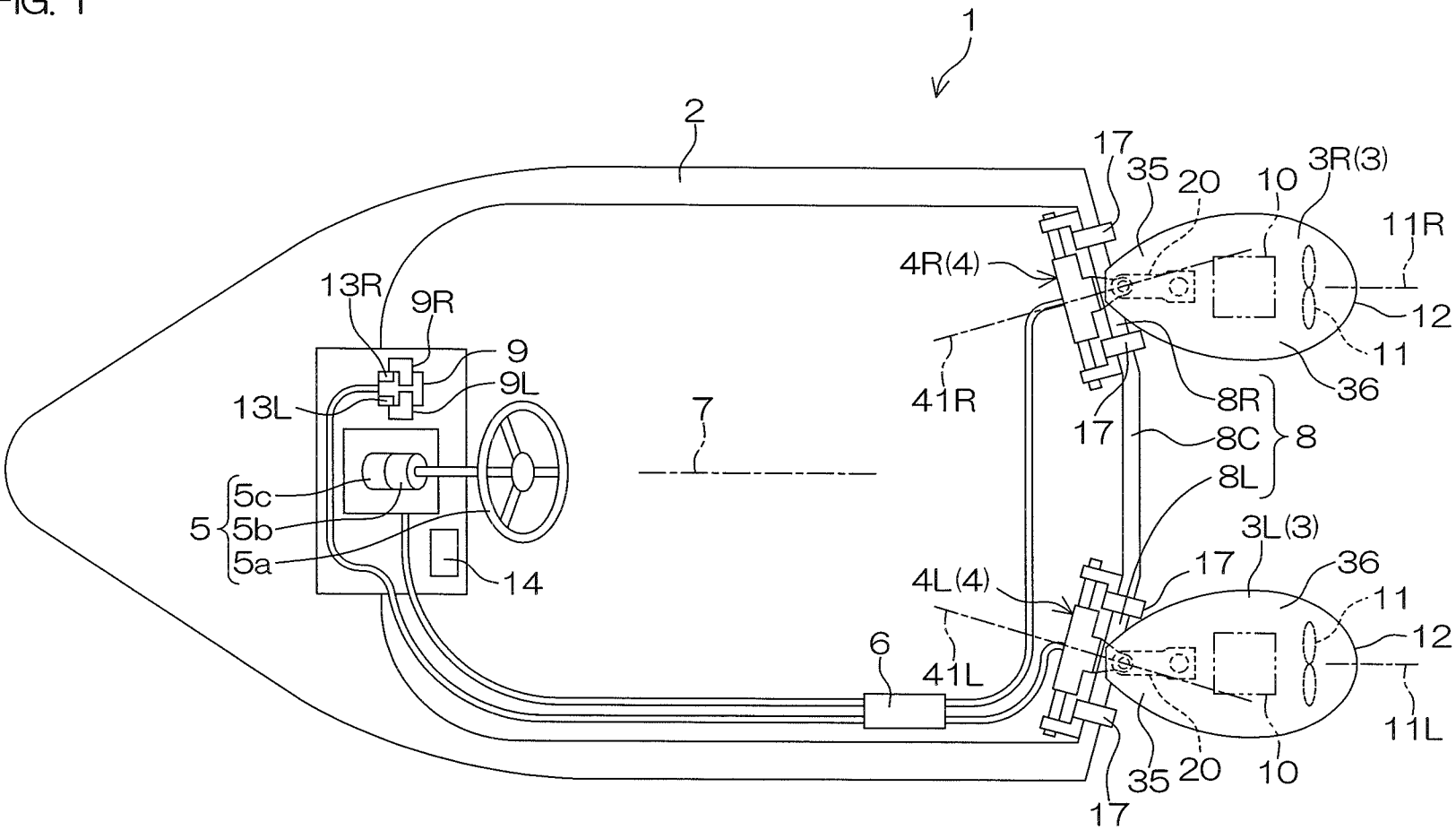
FIG. 1 is an illustrative plan view for describing an configuration of a vessel according to a preferred embodiment of the present invention.

FIG. 1 is an illustrative plan view for describing a configuration of a vessel according to a preferred embodiment of the present invention. The vessel 1 includes a hull 2, a pair of outboard motors 3, a pair of turning mechanisms 4, a steering device 5, and a controller 6.

The pair of outboard motors 3 is an example of a plurality of propulsion apparatuses. The pair of outboard motors 3 include a portside outboard motor 3L disposed on the port side of a stern and a starboard side outboard motor 3R disposed on the starboard side of the stern. The portside outboard motor 3L is disposed on the left side with respect to a hull center line 7 that divides the hull 2 into two equal or substantially equal left and right portions in a plan view. The starboard side outboard motor 3R is disposed on the right side with respect to the hull center line 7. The portside outboard motor 3L is an example of a left propulsion apparatus, and the starboard side outboard motor 3R is an example of a right propulsion apparatus.

A transom board 8 of the hull 2 includes a central transom portion 8C that is disposed in the vicinity of the hull center line 7 and perpendicular or substantially perpendicular to the hull center line 7. The transom board 8 further includes a portside transom portion 8L and a starboard side transom portion 8R respectively provided on the left and right of the central transom portion 8C. The portside transom portion 8L and the starboard side transom portion 8R are inclined with respect to the central transom portion 8C. In the present preferred embodiment, the portside transom portion 8L and the starboard side transom portion 8R are inclined symmetrically with respect to the hull center line 7, so as to head forward toward the outside along the width direction of the hull 2. In a plan view, the portside transom portion 8L shows a substantially linear shape, and a normal line thereto intersects the hull center line 7 from the left side at a position further to the front than the stern. Similarly, in a plan view, the starboard side transom portion 8R shows a substantially linear shape, and a normal line thereto intersects the hull center line 7 from the right side at a position further to the front than the stern.

The portside outboard motor 3L is mounted in a state of being swingable (turnable) in the left-right direction with respect to the portside transom portion 8L. The starboard side outboard motor 3R is mounted in a state of being swingable (turnable) in the left-right direction with respect to the starboard side transom portion 8R. The left and right outboard motors 3L and 3R have no mechanical linkage therebetween, and are configured to be able to turn independently of each other.

The portside outboard motor 3L is configured to turn by equal or substantially equal angles to the left and right with respect to the direction along the normal line of the portside transom portion 8L. A turning center line 41L (hereinafter, referred to as a "port turning center line 41L") that divides the entire turning angle range of the portside outboard motor 3L into two equal or substantially equal left and right parts, in the present preferred embodiment, extends along the direction of the normal line of the portside transom portion 8L. Thus, the port turning center line 41L intersects the hull center line 7 from the left side at a position further to the front than the portside outboard motor 3L.

Similarly, the starboard side outboard motor 3R is configured to turn by equal or substantially equal angles to the left and right with respect to the direction along the normal line of the starboard side transom portion 8R. A turning center line 41R (hereinafter, referred to as a "starboard turning center line 41R") that divides the entire turning angle range of the starboard side outboard motor 3R into two equal or substantially equal left and right portions, in the present preferred embodiment, extends along the direction of the normal line of the starboard side transom portion 8R. Thus, the starboard turning center line 41R intersects the hull center line 7 from the right side at a position further to the front than the starboard side outboard motor 3R.

Each outboard motor 3 includes an engine (internal combustion engine) 10 as an example of a motor, and a propeller 11 to be driven to rotate by the engine 10. An upper portion thereof in which the engine 10 is housed is protected by a top cowling 12 (engine cover). The top cowling 12 has a streamlined (drop-shaped) external form in a plan view, and the top cowling 12 defines an external form of the outboard motor 3 in a plan view. That is, the outboard motor 3 has an external form in a plan view which becomes wider toward the rear (more precisely, as it separates from the swing center). In other words, the outboard motor 3 includes a front portion 35 opposed to the stern, and a wide portion 36 that is arranged farther to the rear than the front portion 35 and wider than the front portion 35.

The pair of turning mechanisms 4 include a portside turning mechanism 4L corresponding to the portside outboard motor 3L, and a starboard side turning mechanism 4R corresponding to the starboard side outboard motor 3R. The portside outboard mechanism 4L swings (turns) the portside outboard motor 3L to the left and right. The starboard side turning mechanism 4R swings (turns) the starboard side outboard motor 3R to the left and right. The portside outboard mechanism 4L and the starboard side turning mechanism 4R do not mechanically interlock, and are individually actuated by the controller 6.

The steering device 5 includes a steering wheel 5*a*, a steering angle sensor 5*b* that detects a steering angle (operation angle) of the steering wheel 5*a*, and a reaction force actuator 5*c* that applies an operational reaction force to the steering wheel 5*a*. The steering wheel 5*a* is an example of an operating member that is operated to the left and right by a vessel operator. An output signal of the steering angle sensor 5*b* is input to the controller 6. The controller 6 is configured or programmed to control the reaction force actuator 5*c*. The reaction force actuator 5*c* may be an electric motor.

Near the steering device 5, an accelerator operation unit 9 configured to adjust the thrust of the left and right outboard motors 3L and 3R is provided. The accelerator operation unit 9 includes a left accelerator lever 9L corresponding to the port side outboard motor 3L and a right accelerator lever 9R corresponding to the starboard side outboard motor 3R. The left and right accelerator levers 9L and 9R are configured to be respectively tilted in the front-rear direction. The operation positions of the left and right accelerator levers 9L and 9R are detected by a left lever position sensor 13L and a right lever position sensor 13R, respectively. Output signals of the lever position sensors 13L and 13R are input to the controller 6. As a result of tilting the accelerator lever 9L, 9R forward by a predetermined amount or more from a neutral position, the corresponding outboard motor 3L, 3R generates a thrust in the forward drive direction. As a result of tilting the accelerator lever 9L, 9R rearward by a predetermined amount or more from the neutral position, the corresponding outboard motor 3L, 3R generates a thrust in the reverse drive direction. The greater the tilt amount from the neutral position of the accelerator lever 9L, 9R, the greater the throttle opening degree of the engine 10, and output (specifically, engine speed) is accordingly increased.

The controller 6 preferably is a so-called electronic control unit (ECU), and includes a microcomputer. The controller 6 is configured or programmed to control the operation of the turning mechanisms 4 according to the steering angle detected by the steering angle sensor 5*b*. Also, the controller 6 is configured or programmed to control the output of the engine 10 according to the operation of the accelerator operation unit 9 detected by the lever position sensors 13L and 13R. The controller 6 is an example of a control unit according to various preferred embodiments of the present invention.

Figure 2:
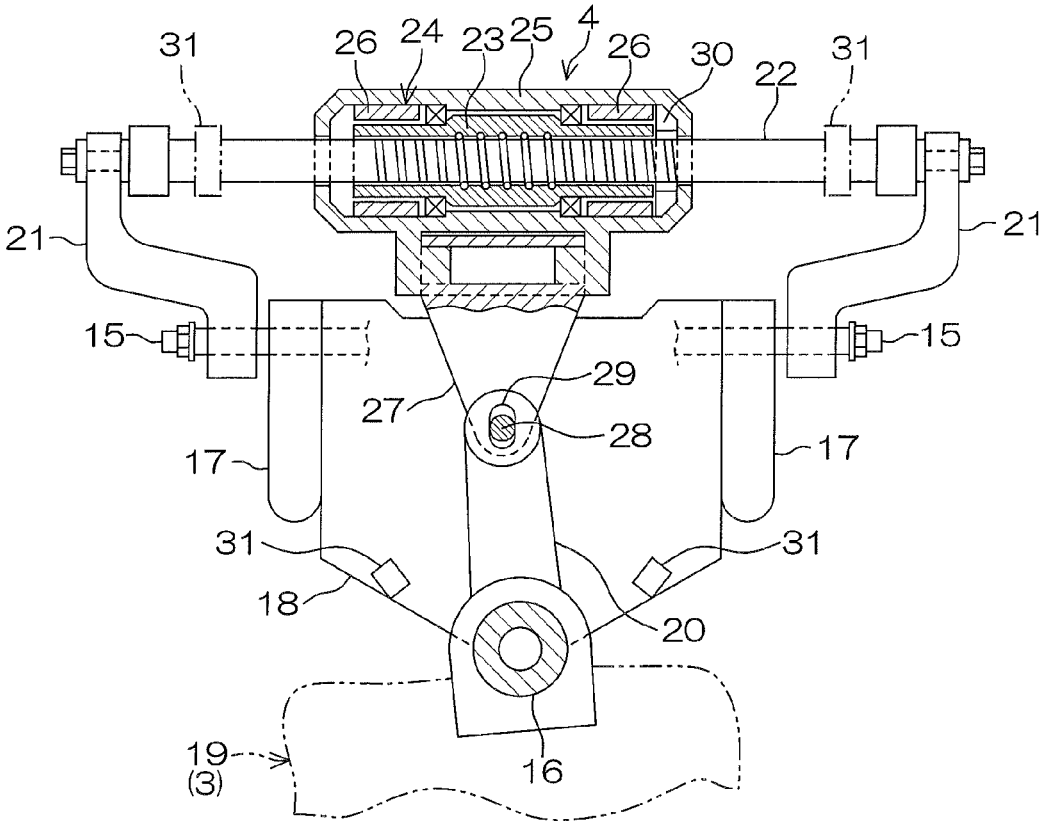
FIG. 2 is a horizontal sectional view for describing an configuration of a turning mechanism provided in the vessel.

FIG. 2 is a horizontal sectional view for illustrating an configuration of the turning mechanism 4. The outboard motor 3 is mounted on the transom board 8 (refer to FIG. 1) of the hull 2 via clamp brackets 17 and a swivel bracket 18. More specifically, the clamp brackets 17 are fixed to the transom board 8, and the clamp brackets 17 are linked to the swivel bracket 18. Further, the outboard motor 3 is mounted in a state of being swingable (turnable) in the left-right direction with respect to the swivel bracket 18. In greater detail, the clamp brackets 17 support the swivel bracket 18 to be freely pivotable in the up-down direction via a tilt shaft 15 extending in the left-right direction. The swivel bracket 18 has a steering shaft 16 erected at its rear end. With respect to the steering shaft 16, a main body 19 of the outboard motor 3 is supported to be freely pivotable in the left-right direction.

The outboard motor main body 19 is provided with a steering bracket 20 extending further to the front side than the steering shaft 16. By swinging the steering bracket 20 around the steering shaft 16, the outboard motor 3 is capable of being turned to the left and right with respect to the swivel bracket 18.

The turning mechanism 4 includes a pair of left and right support members 21, a ball screw shaft 22, a ball screw nut 23, and a turning actuator 24. The turning actuator 24 is, in the example of FIG. 2, an electric motor. The pair of support members 21 are freely pivotally supported via the tilt shaft 15 on the cramp bracket 17. The ball screw shaft 22 is laid between the support members 21. The ball screw nut 23 is screwed on the ball screw shaft 22. The turning actuator 24 is arranged to rotate the ball screw nut 23 around the ball screw shaft 22, and has a housing 25 to house the ball screw nut 23. In the following, the turning actuators 24 respectively corresponding to the portside turning mechanism 4L and the starboard side turning mechanism 4R are, when distinguished from each other, referred to as, for example, a "portside turning actuator 24L" and a "starboard side turning actuator 24R," respectively.

The ball screw shaft 22 is supported on the support members 21 such that its axis is along the left-right direction of the hull 2. The ball screw nut 23 is freely pivotally supported inside the housing 25, and restricted from moving in an axial direction of the housing 25 (parallel or substantially parallel to the axial direction of the ball screw shaft 23).

The turning actuator 24 includes stators 26 fixed inside the housing 25, and drives and rotates the ball screw nut 23 serving as a rotor by energization of the coils (not shown) of the stators 26. The rotation by the turning actuator 24 is controlled by the controller 6. Inside the housing 25, a turning angle sensor 30 is provided which detects a turning angle of the outboard motor 3 by detection of a rotation of the ball screw nut 23. The turning angle sensor 30 may include, for example, a gap sensor that detects numbers of grooves (ridges) provided on the outer peripheral surface of the ball screw nut 23 based on magnetic flux changes. In the following, the turning angle sensors 30 respectively annexed to the portside turning mechanism 4L and the starboard side turning mechanism 4R are, when distinguished from each other, referred to as, for example, a "starboard side turning angle sensor 30L" and a "portside turning angle sensor 30R," respectively.

The housing 25 includes a turning arm 27 extending rearward toward the outboard motor 3. At the rear end of the turning arm 27, a coupling pin 28 is erected. Over the coupling pin 28, a long hole 29 provided at the tip end of the steering bracket 20 is loosely fitted. Accordingly, the steering bracket 20 is freely pivotally coupled with respect to the turning arm 27.

Due to such an configuration, when the ball screw nut 23 is rotated by the turning actuator 24, the ball screw nut 23 moves in the left-right direction along the ball screw shaft 22. Accordingly, the housing 25 is caused to move in the left-right direction, and the steering bracket 20 linked to the steering arm 27 swings around the steering shaft 16. As a result, turning of the outboard motor 3 linked to the steering bracket 20 is achieved.

In order to physically limit the turning angle range of the outboard motor main body 19, stoppers 31 may be provided. The stoppers 31 may either be fixed to the steering bracket 20, or be fixed onto the ball screw shaft 22. The stoppers 31 fixed to the steering bracket 20 are brought into contact with the outboard motor main body 19 to restrict the turning angle range of the outboard motor main body 19. The stoppers 31 fixed onto the ball screw shaft 22 are brought into contact with the housing 25 to restrict the moving range of the housing 25, thus restricting the turning angle range of the outboard motor main body 19.

Figure 3:
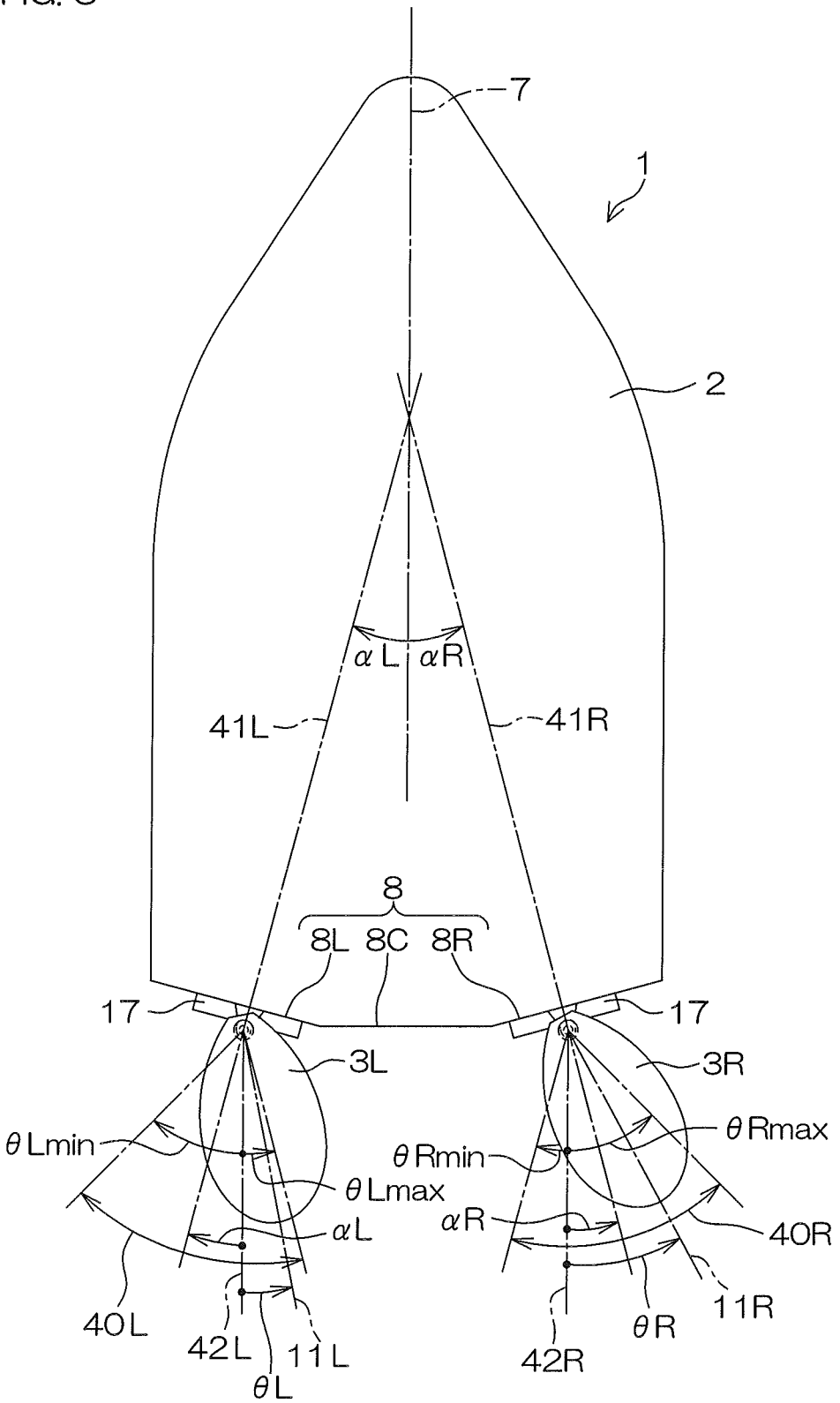
FIG. 3 is an illustrative plan view for describing turning angle ranges of outboard motors provided in the vessel.

FIG. 3 is an illustrative plan view for describing the turning angle ranges of the outboard motors 3. The turning angle range is an entire angle range in which each outboard motor 3 is capable of turning. A turning angle range 40L of the portside outboard motor 3L will be referred to as a "port turning angle range 40L," and a turning angle range 40R of the starboard side outboard motor 3R will be referred to as a "starboard turning angle range 40R." The center line of the port turning angle range 40L is a port turning center line 41L, and the center line of the starboard turning angle range 40R is a starboard turning center line 41R. The port turning center line 41L extends along the direction of the normal line of the portside transom portion 8L, and intersects the hull center line 7 from the left side at a position further to the front than the portside transom portion 8L. The starboard turning center line 41R extends along the direction of the normal line of the starboard side transom portion 8R, and intersects the hull center line 7 from the right side at a position further to the front than the starboard side transom portion 8R.

Turning angles of the outboard motors 3 are defined with reference to the front-rear direction of the hull 2, that is, the hull center line 7, and the turning direction in which the outboard motor 3 moves to the right side (counterclockwise direction in a plan view) is defined as a positive turning direction, and the turning direction in which the outboard motor 3 moves to the left side (clockwise direction in a plan view) is defined as a negative turning direction. The turning angle is an angle between the hull center line 7 and the direction of an action line 11L, 11R of the thrust generated by the outboard motor 3L, 3R in a plan view. The thrust action line 11L, 11R is, specifically, a straight line along the direction of action of the thrust generated by the outboard motor 3L, 3R as a result of each propeller 11 of the outboard motor 3L, 3R rotating. In the accompanying drawings, the thrust action lines 11L are 11R are drawn so as to be coincident with respective propeller rotation axes of the outboard motors 3L and 3R. However, in actuality, because of propeller reaction forces, the thrust action lines 11L are 11R are not always coincident with the propeller rotation axes of the outboard motors 3L and 3R.

A port turning neutral line 42L and a starboard turning neutral line 42R that respectively pass through the turning centers of the outboard motors 3L and 3R and are parallel or substantially parallel to the hull center line 7 are introduced. When the thrust action line 11L of the portside outboard motor 3L is parallel or substantially parallel with the hull center line 7, the thrust action line 11L is coincident with the port turning neutral line 42L. That is, the port turning neutral line 42L is corresponding to a turning neutral position of the portside outboard motor 3L. Similarly, when the thrust action line 11R of the starboard side outboard motor 3R is parallel or substantially parallel with the hull center line 7, the thrust action line 11R is coincident with the starboard turning neutral line 42R. That is, the starboard turning neutral line 42R is corresponding to a turning neutral position of the starboard side outboard motor 3R. The turning angle (hereinafter, referred to as a "port turning angle") θL of the portside outboard motor 3L is an angle that the thrust action line 11L defines with respect to the port turning neutral line 42L. Similarly, the turning angle (hereinafter, referred to as a "starboard turning angle") θR of the starboard side outboard motor 3R is an angle that the thrust action line 11R defines with respect to the starboard turning neutral line 42R.

When the thrust action line 11L of the portside outboard motor 3L is parallel or substantially parallel to the hull center line 7, the port turning angle θL is zero or substantially zero. When the thrust action line 11L intersects the hull center line 7 in the rear of the portside outboard motor 3L, the port turning angle θL takes a positive value. When the thrust action line 11L intersects the hull center line 7 in front of the portside outboard motor 3L, the port turning angle θL takes a negative value. On the other hand, when the thrust action line 11R of the starboard side outboard motor 3R is parallel or substantially parallel to the hull center line 7, the starboard turning angle θR is zero or substantially zero. When the thrust action line 11R intersects the hull center line 7 in front of the starboard side outboard motor 3R, the starboard turning angle θR takes a positive value. When the thrust action line 11R intersects the hull center line 7 in the rear of the starboard side outboard motor 3R, the starboard turning angle θR takes a negative value.

The turning angle when the action line 11L, 11R of the outboard motor is parallel (coincident in a plan view) or substantially parallel with the turning center line 41L, 41R are defined as a "reference angle." In other words, the reference angle is an angle that the turning centerline 41L, 41R defines with respect to the hull center line 7. The reference angle (hereinafter, referred to as a "port reference angle") αL of the portside outboard motor 3L takes a negative value, and the reference angle (hereinafter, referred to as a "starboard reference angle") αR of the starboard side outboard motor 3R takes a positive value. If the portside transom portion 8L and the starboard side transom portion 8R are symmetrical with respect to the hull center line 7, absolute values of the port reference angle αL and the starboard reference angle αR are equal or substantially equal to each other.

In terms of "relative turning angles" with reference to the turning center line 41L, 41R, conversion equations between the relative turning angle and the turning angle θL, θR with reference to the hull center line 7 are as in the following expressions (1) and (2):

$$\text{Port turning angle } \theta L = \text{Relative turning angle of portside outboard motor} + \text{Port reference angle } \alpha L \quad (1)$$

$$\text{Starboard turning angle } \theta R = \text{Relative turning angle of starboard side outboard motor} + \text{Starboard reference angle } \alpha R \quad (2)$$

As a specific non-limiting example, a case in which the port reference angle αL is −15°, the starboard reference angle αR is +15°, the port turning angle range 40L is 60°, and the starboard turning angle range 40R is 60° is considered. In this case, the relative turning angles vary in the range of −30° to +30° with reference (0°) to the turning center line 41L, 41R. The port turning angle θL accordingly varies in the range of −45° to +15°, and the starboard turning angle θR accordingly varies in the range of −15° to +45°, for example.

Figure 4:
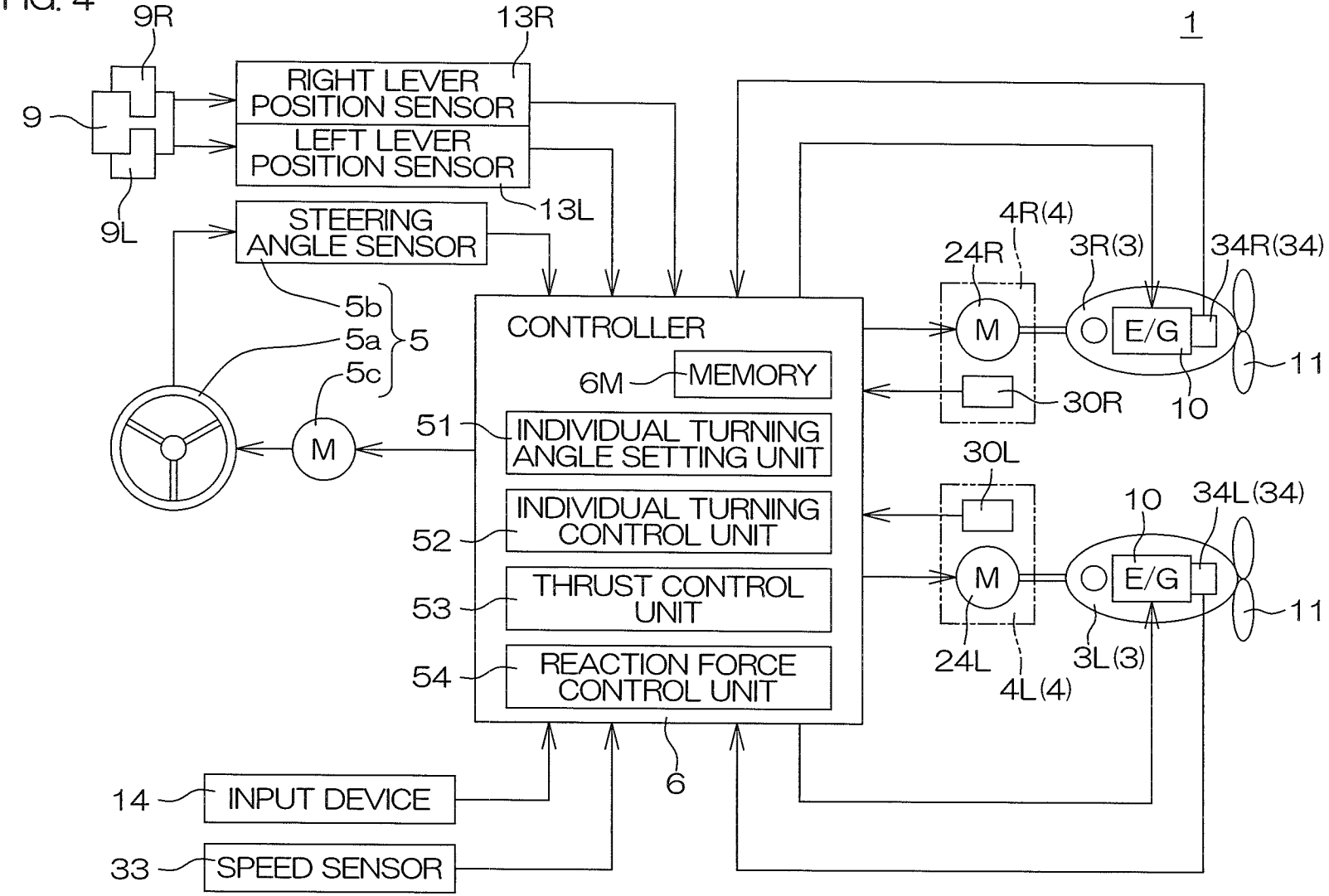
FIG. 4 is a block diagram for describing an electrical configuration related to turning control of the vessel.

FIG. 4 is a block diagram for describing an electrical configuration related to turning control of the vessel 1. Output signals of the steering angle sensor 5*b* and the left and right turning angle sensors 30L and 30R are input to the controller 6. Based on these signals, the controller 6 controls the turning actuators 24L and 24R provided in the left and right turning mechanisms 4L, 4R and the reaction force actuator 5*c*. A speed sensor 33 and an input device 14 may be connected to the controller 6 according to necessity. The speed sensor 33 detects the speed of the vessel 1. The input device 14 may be, as shown in FIG. 1, an input interface device provided in the vicinity of the steering device 5. The input interface device may be an input button or a touch panel provided in a display device. The display device may include meters (so-called gauges) that display the engine speed and other information. Alternatively, the controller 6 may include an external connection interface to which an information processing device such as a computer can be connected. In this case, the input device 14 may be an information processing device that is connected to the external connection interface according to necessity.

The controller 6 preferably includes a CPU (not shown) and a memory 6M, and is configured or programmed to provide a plurality of function processing units by executing a predetermined program. More specifically, the controller 6 is configured or programmed to execute functions as an individual turning angle setting unit 51, an individual turning control unit 52, a thrust control unit 53, and a reaction force control unit 54. The memory 6M is an example of a storage unit that stores the reference angles $\alpha$L and $\alpha$R.

The function as the individual turning angle setting unit 51 is a function of individually setting a turning command angle (hereinafter, referred to as a "port turning command angle") $\theta$L* of the portside outboard motor 3L and a turning command angle (hereinafter, referred to as a "starboard turning command angle") $\theta$R* of the starboard side outboard motor 3R. The function of the individual turning angle setting unit 51 includes a function as a turning command angle computing unit according to various preferred embodiments of the present invention.

The function as the individual turning control unit 52 is a function of individually controlling turning of the portside outboard motor 3L and the starboard side outboard motor 3R according to the individually set left and right turning command angles $\theta$L* and $\theta$R*. The function as the thrust control unit 53 is a function of controlling the thrust (including generation/stop of the thrust) of the outboard motor 3 according to an output signal of the lever position sensor 13L, 13R. The function as the reaction force control unit 54 is a function of controlling the reaction force actuator 5*c* according to the steering angle detected by the steering angle sensor 5*b* to apply an appropriate operational reaction force to the steering wheel 5*a*.

The outboard motor 3 is provided with a shift mechanism, and the shift mechanism is controlled so as to be moved to any of the shift positions including a forward drive position, a reverse drive position, and a neutral position. The forward drive position is a shift position to transmit the drive force of the engine 10 to the propeller 11 such that the propeller 11 rotates in a rotation direction to generate a thrust in the forward drive direction. The reverse drive position is a shift position to transmit the drive force of the engine 10 to the propeller 11 such that the propeller 11 rotates in a rotation direction to generate a thrust in the reverse drive direction. The neutral position is a shift position not to transmit the drive force of the engine 10 to the propeller 11. Thus, by controlling the shift position of the shift mechanism to the neutral position, generation of the thrust is reliably stopped.

The function as the thrust control unit 53 of the controller 6 includes a function of instructing the outboard motor 3 on a shift position according to the output signal of the lever position sensor 13L, 13R. That is, if the accelerator lever 9L, 9R is located at a forward position not closer than a predetermined forward drive shift position, the thrust control unit 53 gives a shift position command instructing the corresponding outboard motor 3 on the forward drive position. Also, if the accelerator lever 9L, 9R is located at a rearward position not closer than a predetermined reverse drive shift position, the thrust control unit 53 gives a shift position command instructing the corresponding outboard motor 3 on the reverse drive position. If the accelerator lever 9L, 9R is located between the forward drive shift position and the reverse drive shift position, the thrust control unit 53 gives a shift position command instructing the corresponding outboard motor 3 on the neutral position.

If a lever position between the forward drive shift position and the reverse drive shift position has been detected, the thrust control unit 53 outputs a command to control the rotation speed of the engine 10 of the corresponding outboard motor 3 to an idling rotation speed. If the accelerator lever 9L, 9R has been operated forward beyond the forward drive shift position, the thrust control unit 53 gives an engine speed command according to the position of the accelerator lever 9L, 9R to the corresponding outboard motor 3. Similarly, if the accelerator lever 9L, 9R has been operated rearward beyond the reverse drive shift position, the thrust control unit 53 gives an engine speed command according to the position of the accelerator lever 9L, 9R to the corresponding outboard motor 3.

The portside outboard motor 3L and the starboard side outboard motor 3R are respectively provided with engine rotation detection units 34L and 34R (hereinafter, collectively referred to as an "engine rotation detection unit 34"). The engine rotation detection unit 34 may be a crank angle sensor to detect a crank angle of the engine 10. An engine speed preferably is determined based on an output signal of the engine rotation detection unit 34. For example, an engine ECU (not shown) provided in each outboard motor 3 supplies engine speed information to the controller 6.

Figure 5B:
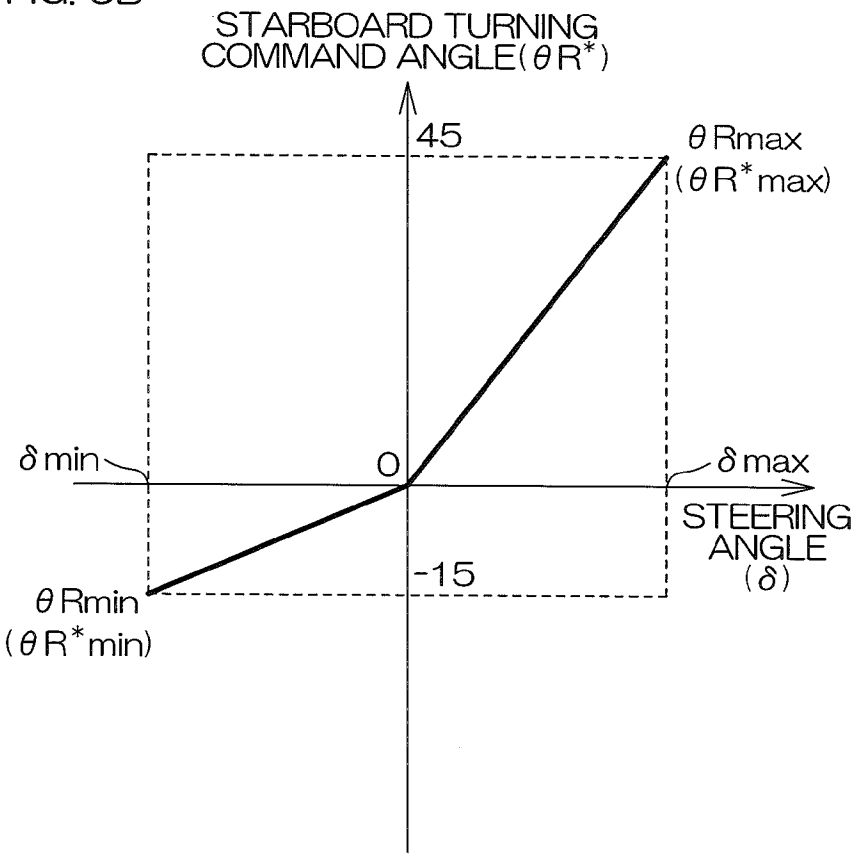
FIG. 5A and FIG. 5B are views showing examples of a turning command angle map to set a turning command angle in response to a steering angle.
Figure 5A:
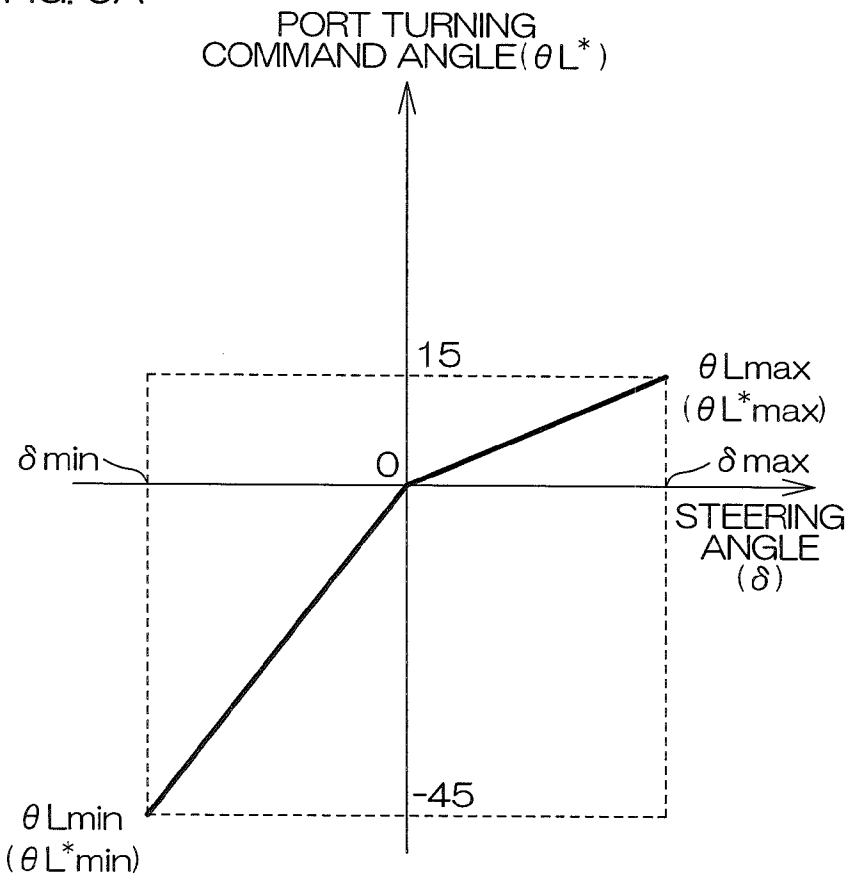

FIG. 5A and FIG. 5B are views for describing examples of individual control of the port turning angle $\theta$L and the starboard turning angle $\theta$R, and represent turning command angles $\theta$L* and $\theta$R* that change according to the steering angle $\delta$. More specifically, the controller 6 has stored therein the turning command angle maps shown in FIG. 5A and FIG. 5B in the memory 6M (refer to FIG. 4). FIG. 5A shows a turning command angle map (port turning command angle map) to set the port turning command angle $\theta$L*, and FIG. 5B shows a turning command angle map (starboard turning command angle map) to set the starboard turning command angle $\theta$R*.

When the steering angle $\delta$ of the steering wheel 5*a* is 0° (a neutral steering command), the turning command angle (port turning command angle) $\theta$L* of the portside outboard motor 3L and the turning command angle (starboard turning command angle) $\theta$R* of the starboard side outboard motor 3R are both 0°. That is, the thrust action line 11L of the portside outboard motor 3L is coincident with the port turning neutral line 42L, and the thrust action line 11R of the starboard side outboard motor 3R is coincident with the starboard turning neutral line 42R. Accordingly, feedback control is performed such that the turning angles $\theta$L and $\theta$R of the portside outboard motor 3L and the starboard side outboard motor 3R both become 0', and the portside outboard motor 3L and the starboard side outboard motor 3R generate thrusts along the front-rear direction parallel or substantially parallel to the hull center line 7. Thus, the vessel 1 travels straight. That is, in the present preferred embodiment, straight traveling postures of the portside outboard motor 3L and the starboard side outboard motor 3R are postures when their respective turning angles $\theta$L and $\theta$R are 0°, that is, postures in which the action lines 11L and 11R of thrusts become parallel or substantially parallel with the hull center line 7.

The straight traveling postures are postures of the outboard motors 3 when making the vessel 1 travel straight. When the vessel 1 is made to travel straight, thrusts in directions parallel or substantially parallel to the hull center line 7 are not always generated from the outboard motors 3. Specifically, the turning angles θL and θR in straight traveling are sometimes controlled such that the portside outboard motor 3L and the starboard side outboard motor 3R define a predetermined toe angle. The toe angle is an angle between the thrust action lines 11L and 11R of the left and right outboard motors 3L and 3R. When the thrust action lines 11L and 11R intersect in front of the outboard motors 3, the action lines 11L and 11R define an inverted V-shape in a plan view of the hull 2 with its bow positioned in front. When the thrust action lines 11L and 11R intersect in the rear of the outboard motors 3, the action lines 11L and 11R define a V-shape in the same plan view.

When a vessel operator rotates the steering wheel 5*a* in the right direction in order to turn the vessel 1 in the right direction, the steering angle δ increases, and when the vessel operator rotates the steering wheel 5*a* in the right direction beyond a steering neutral position, the steering angle δ takes a positive value. The positive value of the steering angle δ is assigned to a positive value of the turning command angle θL*, θR* corresponding thereto. On the other hand, when a vessel operator rotates the steering wheel 5*a* in the left direction in order to turn the vessel 1 in the left direction, the steering angle δ decreases, and when the vessel operator rotates the steering wheel 5*a* in the left direction beyond the steering neutral position, the steering angle δ takes a negative value. The negative value of the steering angle δ is assigned to a negative value of the turning command angle θL*, θR* corresponding thereto.

The "steering neutral position" is a rotation position of the steering wheel 5*a* when the outboard motors 3L and 3R take straight traveling postures. The steering wheel 5*a* may be a limited rotation type that is physically limited in the range in which the steering wheel is rotatable to the left and right. For example, its left end rotating position to right end rotating position (lock-to-lock) may be limited to four turns, and the steering wheel may be rotatable by a certain rotation angle (720°, equivalent to two turns) each equally or substantially equally to the left and right from the steering neutral position. In this case, the steering angle sensor 5*b* outputs a rotating position signal corresponding to a steering amount to the left or right with respect to the steering neutral position. On the other hand, the steering wheel 5*a* may be an unlimited rotation type arranged to be able to rotate to the left and right without limitation. In this case, when the vessel 1 starts to be operated, the controller 6 executes an initial setting processing to make an output signal of the steering angle sensor 5*b* when the outboard motors 3L and 3R take straight traveling postures correspond to the steering neutral position. The controller 6 detects an operation amount to the left or right of the steering wheel 5*a* with respect to the steering neutral position based on an output signal of the steering angle sensor 5*b*. The controller 6 determines the steering angle δ based on the operation amount. The steering angle δ is a steering command to be output by the steering device 5.

In the case where the unlimited rotation type steering wheel 5*a* is provided, it is preferable that the controller 6 generates a large operational reaction force to be generated from the reaction force actuator 5*c* when the rotation angle to the left or right from the steering neutral position has reached a predetermined rotation angle (for example, about 720°). Accordingly, the vessel operator is made aware of reaching the end of a steering range.

The port turning command angle map and the starboard turning command angle map both provide turning command angle characteristics to make the turning command angle θL*, θR* correspond so as to increase monotonously with respect to an increase in the steering angle δ. Further, in a negative steering angle region corresponding to the steering angle δ on the left side with respect to the steering neutral position (δ=0), the turning command angle θL*, θR* is made to correspond so as to increase linearly, in a range from a lower limit turning angle value θLmin, θRmin to 0, with respect to the steering angle δ. Further, in a positive steering angle region corresponding to the steering angle δ on the left side with respect to the turning neutral position, the turning command angle θL*, θR* is made to correspond so as to increase linearly, in a range from 0 to an upper limit turning angle value θLmax, θRmax, with respect to the steering angle δ. The negative steering angle region and positive steering angle region are not equal in the rate of increase of the turning command angle θL*, θR* with respect to the steering angle δ, and thus, the turning command angle characteristics show characteristics in a polygonal line shape bent at the steering angle δ=0'.

The port turning command angle characteristic line (FIG. 5A) makes a lower limit steering angle δmin (left end steering angle) correspond to the lower limit port turning angle value θLmin, makes an upper limit steering angle δmax (right end steering angle) correspond to the upper limit port turning angle value θLmax, and makes the steering neutral position (δ=0) correspond to the turning neutral position (θL*=0). The starboard turning command angle characteristic line (FIG. 5B) makes the lower limit steering angle δmin correspond to the lower limit starboard turning angle value θRmin, makes the upper limit steering angle δmax correspond to the upper limit starboard turning angle value θRmax, and makes the steering neutral position (δ=0) correspond to the turning neutral position (θR*=0).

The lower limit port turning angle value θLmin is a lower limit turning angle value of the portside outboard motor 3L, and the upper limit port turning angle value θLmax is an upper limit turning angle value of the portside outboard motor 3L. Similarly, the lower limit starboard turning angle value θRmin is a lower limit turning angle value of the starboard side outboard motor 3R, and the upper limit starboard turning angle value θRmax is an upper limit turning angle value of the starboard side outboard motor 3R. The lower limit turning angle value is a turning angle at the left end of a turning angle range, and corresponding to the maximum left turning angle. Similarly, the upper limit turning angle value is a turning angle at the right end of a turning angle range, and corresponding to the maximum right turning angle. The lower limit turning angle value and the upper limit turning angle values are values that are physically determined by factors such as the structures of the outboard motor 3 and the turning mechanism 4.

The port turning command angle θL* can be set between the lower limit port turning angle value θLmin and the upper limit port turning angle value θLmax. That is, a lower limit value of the port turning command angle θL* (hereinafter, referred to as a "lower limit port turning command angle value") θL*min can be determined to a value not less than the lower limit port turning angle value θLmin. Also, an upper limit value of the port turning command angle θL* (hereinafter, referred to as an "upper limit port turning command angle value") θL*max can be determined to a value not more than the upper limit port turning angle value θLmax. FIG. 5A shows an example in which θL*min=θLmin and θL*max=θLmax, but there may be θL*min>θLmin and/or θL*max<θLmax. Similarly, the starboard turning command angle θR* can be set between the lower limit starboard turning angle value θRmin and the upper limit starboard turning angle value θRmax. That is, a lower limit value of the starboard turning command angle θR* (hereinafter, referred to as a "lower limit starboard turning command angle value") θR*min can be determined to a value not less than the lower limit starboard turning angle value θRmin. Also, an upper limit value of the starboard turning command angle θR* (hereinafter, referred to as an "upper limit starboard turning command angle value") θR*max can be determined to a value not more than the upper limit starboard turning angle value θRmax. FIG. 5B shows an example in which θR*min=θRmin and θR*max=θRmax, but there may be θR*min>θRmin and/or θR*max<θRmax.

The lower limit turning command angle value θL*min, θR*min is a turning command angle at a left end of a turning command angle range, and corresponding to a maximum left turning command angle. The upper limit turning command angle value θL*max, θR*max is a turning command angle at a right end of a turning command angle range, and corresponding to a maximum right turning command angle. In the present preferred embodiment, |θL*min|>|θL*max| and |θR*min|<|θR*max|, in which the maximum left turning command angle and the maximum right turning command angle are different. The lower limit turning commend angle value θL*min, θR*min is an upper limit turning angle whose absolute value is determined to a value not more than the maximum left turning angle. Similarly, the upper limit turning command angle value θL*max, θR*max is an upper limit turning angle whose absolute value is determined to a value not more than the maximum right turning angle.

Regarding the port turning angle θL, the lower limit port turning angle value θLmin (for example, −45° has an absolute value greater than that of the upper limit port turning angle value θLmax (for example, 15°). Therefore, the turning command angle characteristic line in the negative steering angle region has an inclination greater than that of the turning command angle characteristic line in the positive steering angle region. On the other hand, regarding the starboard turning angle θR, the upper limit starboard turning angle value θRmax (for example, 45°) has an absolute value greater than that of the lower limit starboard turning angle θRmin (for example, −15°). Therefore, the turning command angle characteristic line in the positive steering angle region has an inclination greater than that of the turning command angle characteristic line in the negative steering angle region. That is, the turning command angle characteristic line (FIG. 5A) for the portside outboard motor 3L shows a polygonal line that protrudes upward, and the turning command angle characteristic line (FIG. 5B) for the starboard side outboard motor 3R shows a polygonal line that protrudes downward.

As above, characteristics of the port turning command angle θL* and the starboard turning command angle θR* with respect to the steering angle δ are different between the left and right of the steering neutral position (δ=0), and are therefore, different between the left and right of the turning neutral line 42L (θL=0) and the turning neutral line 42R (θR=0), respectively. More respectively, the turning amount with respect to the steering angle δ has different characteristics between the left and right of the turning neutral line 42L, 42R. Also, the rate of change in the turning amount with respect to the steering angle δ has different characteristics between the left and right of the turning neutral line 42L, 42R.

In the present preferred embodiment, because the left and right outboard motors 3L and 3R are mounted on the stern left-right symmetrically with respect to the hull center line 7, the lower limit turning angle value θLmin of the portside outboard motor 3L and the upper limit turning angle θRmax of the starboard side outboard motor 3R are equal or substantially equal in absolute value. Also, the upper limit turning angle value θLmax of the portside outboard motor 3L and the lower limit turning angle θRmin of the starboard side outboard motor 3R are equal or substantially equal in absolute value. Thus, the inclination in the negative steering angle region of the turning command angle characteristic line for the portside outboard motor 3L and the inclination in the positive steering angle region of the turning command angle characteristic line for the starboard side outboard motor 3R are equal or substantially equal. Also, the inclination in the positive steering angle region of the turning command angle characteristic line for the portside outboard motor 3L and the inclination in the negative steering angle region of the turning command angle characteristic line for the starboard side outboard motor 3R are equal or substantially equal.

Figure 6B:
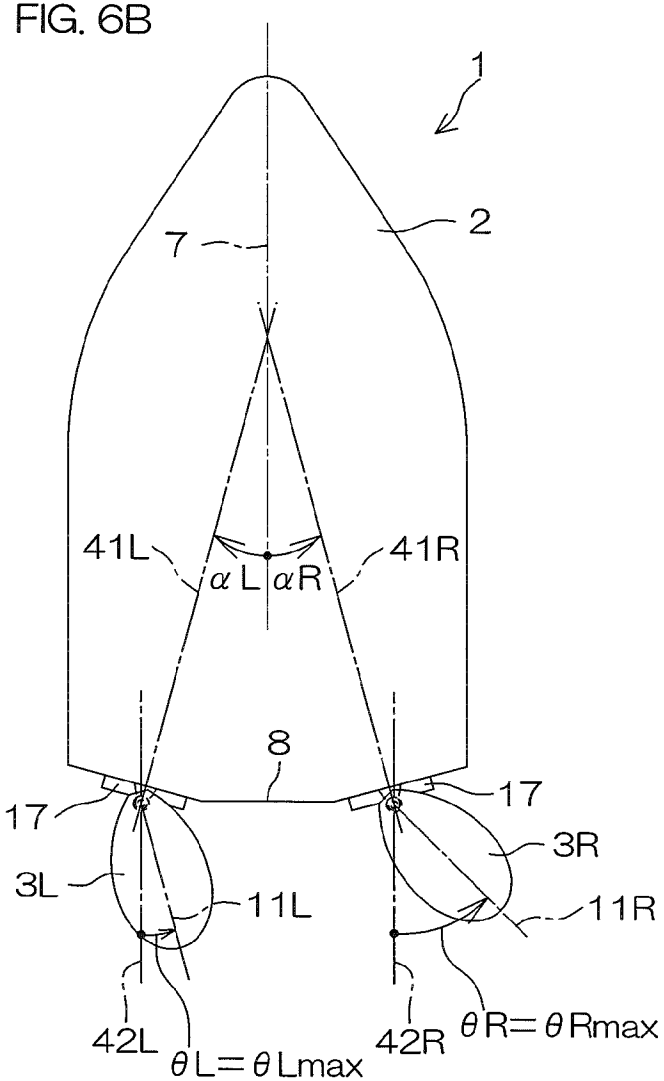
FIG. 6A and FIG. 6B are plan views illustrating turning angle control according to the turning command angle maps shown in FIG. 5A and FIG. 5B.
Figure 6A:
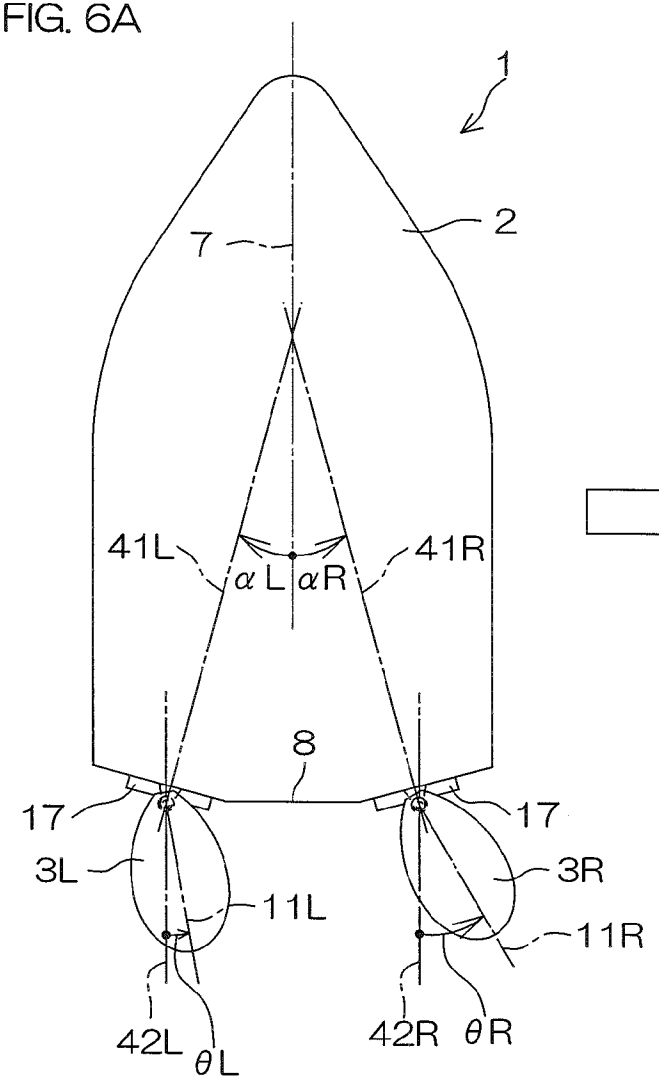

FIG. 6A and FIG. 6B are plan views illustrating turning angle control according to the turning command angle maps shown in FIG. 5A and FIG. 5B, and show a state when the left and right outboard motors 3L and 3R are turned to the right side to turn the vessel 1 to the right side. The turn to the right side indicates that the vessel 1 moves forward or rearward with a trajectory that curves to the right side with respect to the hull center line 7. If the vessel 1 travels forward, a case in which the vessel 1 moves with a trajectory that curves clockwise applies. If the vessel 1 travels rearward, a case in which the vessel 1 moves with a trajectory that curves counterclockwise applies. Similarly, a turn to the left side indicates that the vessel 1 moves forward or rearward with a trajectory that curves to the left side with respect to the hull center line 7. If the vessel 1 travels forward, a case in which the vessel 1 moves with a trajectory that curves counterclockwise applies. If the vessel 1 travels rearward, a case in which the vessel 1 moves with a trajectory that curves clockwise applies.

In the positive steering angle regions, as can be understood from FIG. 5A and FIG. 5B, the rate of change in the turning angle θL of the portside outboard motor 3L is small, and the rate of change in the turning angle θR of the starboard side outboard motor 3R is great. Therefore, when the steering wheel 5*a* is operated to rotate to the right side from the neutral position, the left and right outboard motors 3L and 3R are simultaneously turned to the right side, but the starboard turning angle θR has a change greater than that of the port turning angle θL. Therefore, the starboard turning angle θR is greater than the port turning angle θL, and the difference therebetween is small in a region (refer to FIG. 6A) where the steering angle δ is small, and becomes greater with a greater steering angle δ. FIG. 6B shows a state in which the starboard turning angle θR and the port turning angle θL have reached the upper limit turning angle values θLmax and θRmax. At this time, if the port turning angle range 40L and the stern turning angle range 40R are equal or substantially equal in size, the starboard turning angle θR is greater than the port turning angle θL by a sum of the port reference angle αL and the starboard reference angle αR (αL+αR).

Figure 7B:
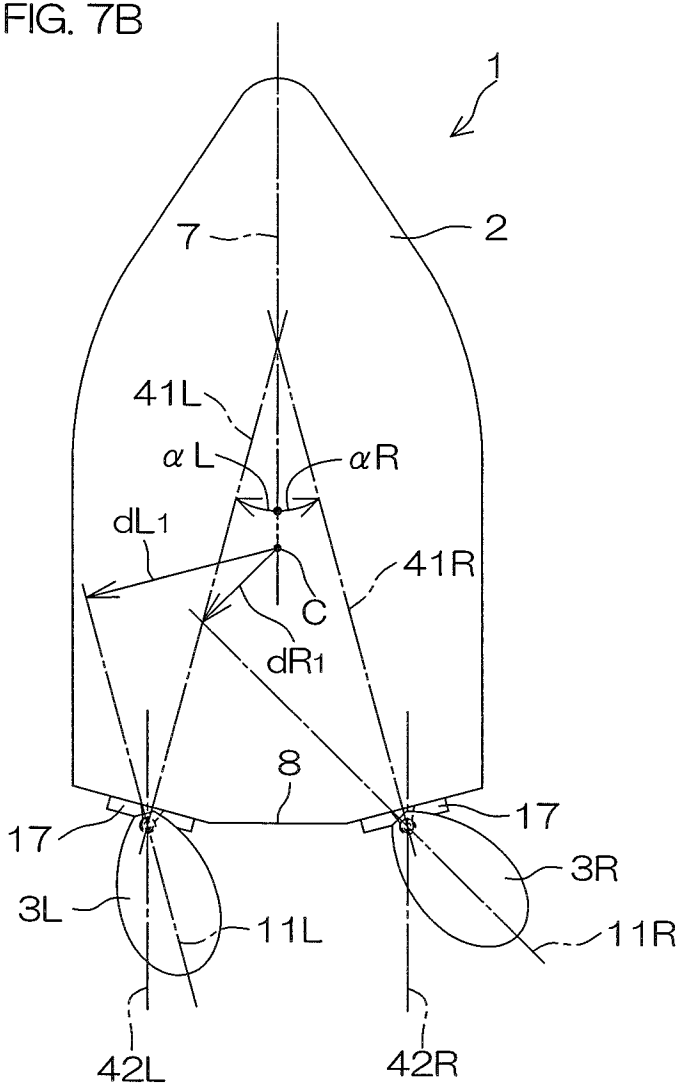
FIG. 7A (comparative example) and FIG. 7B (a preferred embodiment of the present invention) are illustrative plan views for describing an improvement in turning performance by the vessel.
Figure 7A:
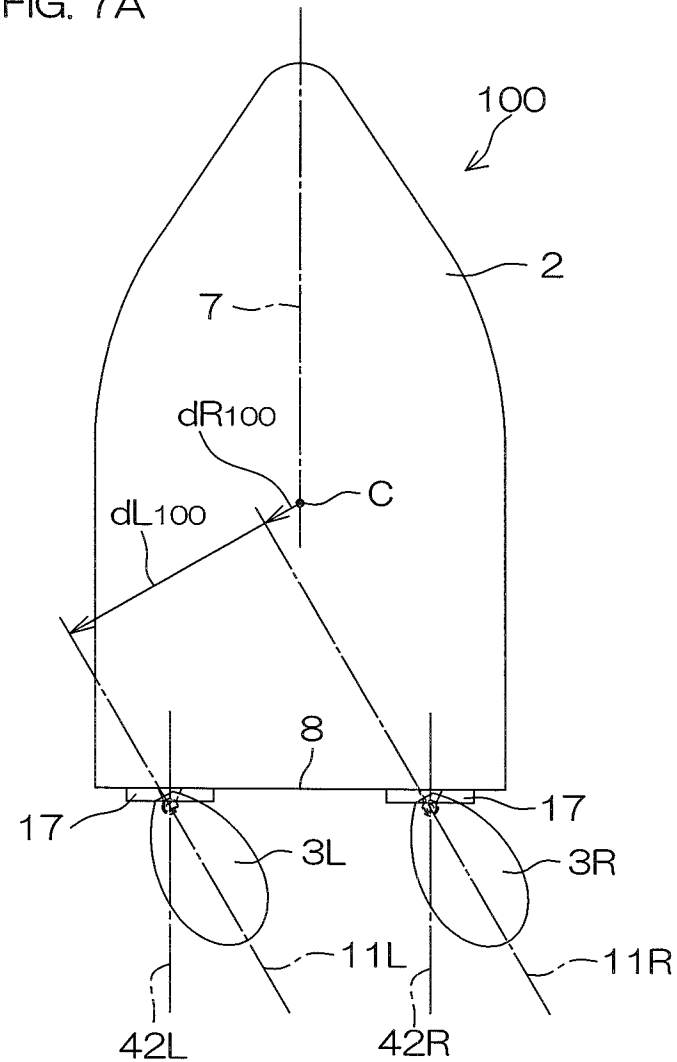

FIG. 7A and FIG. 7B are illustrative plan views for describing an improvement in turning performance by the vessel 1 according to the present preferred embodiment. FIG. 7A shows an illustrative configuration of a vessel 100 according to a comparative example, and FIG. 7B shows an illustrative configuration of the vessel 1 according to the present preferred embodiment.

In the vessel 100 according to the comparative example shown in FIG. 7A, the stern of the hull 2 extends in a direction vertical to the hull center line 7, and the turning center lines 41L and 41R of the two outboard motors 3L and 3R are parallel or substantially parallel with the hull center line 7. Thus, for example, the two outboard motors 3L and 3R are respectively turnable by about 30° each to the left and right. However, when the hull 2 has a small width, because the outboard motors 3L and 3R may interfere with each other, the turning angle of the outboard motor (3L) on the side opposite to a turning direction are limited to a value smaller than the turning angle of the outboard motor (3R) on the side of the turning direction in some cases. A turning moment that the outboard motor 3L, 3R applies to the hull 2 is greater as the thrust action line 11L, 11R thereof is more distant to the side opposite to the turning direction with respect to a center of rotation C of the hull 2. In the vessel 100 according to the comparative example, the thrust action line (11R) of the outboard motor (3R) on the turning direction side is located near the center of rotation C, and has a short distance $dR_{100}$ to the center of rotation C. Therefore, the thrust of the outboard motor (3R) on the turning direction side does not contribute very much to a turn of the hull 2.

In the vessel 1 according to the present preferred embodiment shown in FIG. 7B, the port turning center line 41L and the starboard turning center line 41R define an inverted V-shape in a plan view, and intersect at a position further to the front than the stern. Therefore, the outboard motor (3R) on the turning direction side has the maximum turning angle greater than that in the case of the comparative example of FIG. 7A, and a distance $dR_1$ by which the thrust action line (11R) thereof is distant to the opposite side of the turning direction with respect to the center of rotation C of the hull 2 is longer than that in the case of the comparative example shown in FIG. 7A. Thus, the thrust of the outboard motor (3R) on the turning direction side applies a greater turning moment to the hull 2.

On the other hand, the upper limit turning angle value of the outboard motor (3L) on the side opposite to the turning direction is greater in the case of the comparative example shown in FIG. 7A. However, the mounting position of the outboard motor (3L) on the side opposite to the turning direction is shifted to the opposite side to the turning direction with respect to the hull center line 7. Therefore, also in the configuration of the present preferred embodiment shown in FIG. 7B, the thrust action line (11L) of the outboard motor (3L) on the side opposite to the turning direction is distant by a sufficient distance $dL_1$ from the center of rotation C. Therefore, the thrust of the outboard motor (3L) on the side opposite to the turning direction also applies a great turning moment to the hull 2. As a result, the present preferred embodiment shown by FIG. 7B, in which a greater turning moment is applied to the hull 2 than in the comparative example shown in FIG. 7A, is consequently excellent in turning performance. The distance $dL_{100}$ shown in FIG. 7A is a distance between the thrust action line (11L) of the outboard motor (3L) on the side opposite to the turning direction and the center of rotation C.

The center of rotation C of the hull 2 is the center when the hull 2 rotates. The center of rotation C is coincident or substantially coincident with the center of gravity of the vessel 1 during low-speed traveling. During high-speed traveling, the center of rotation C moves to a position different from the center of gravity due to water flow resistance, and is coincident or substantially coincident with a center of resistance. The center of resistance is a point when resistance received from water is regarded as acting on one point during traveling of the vessel 1.

Figure 8:
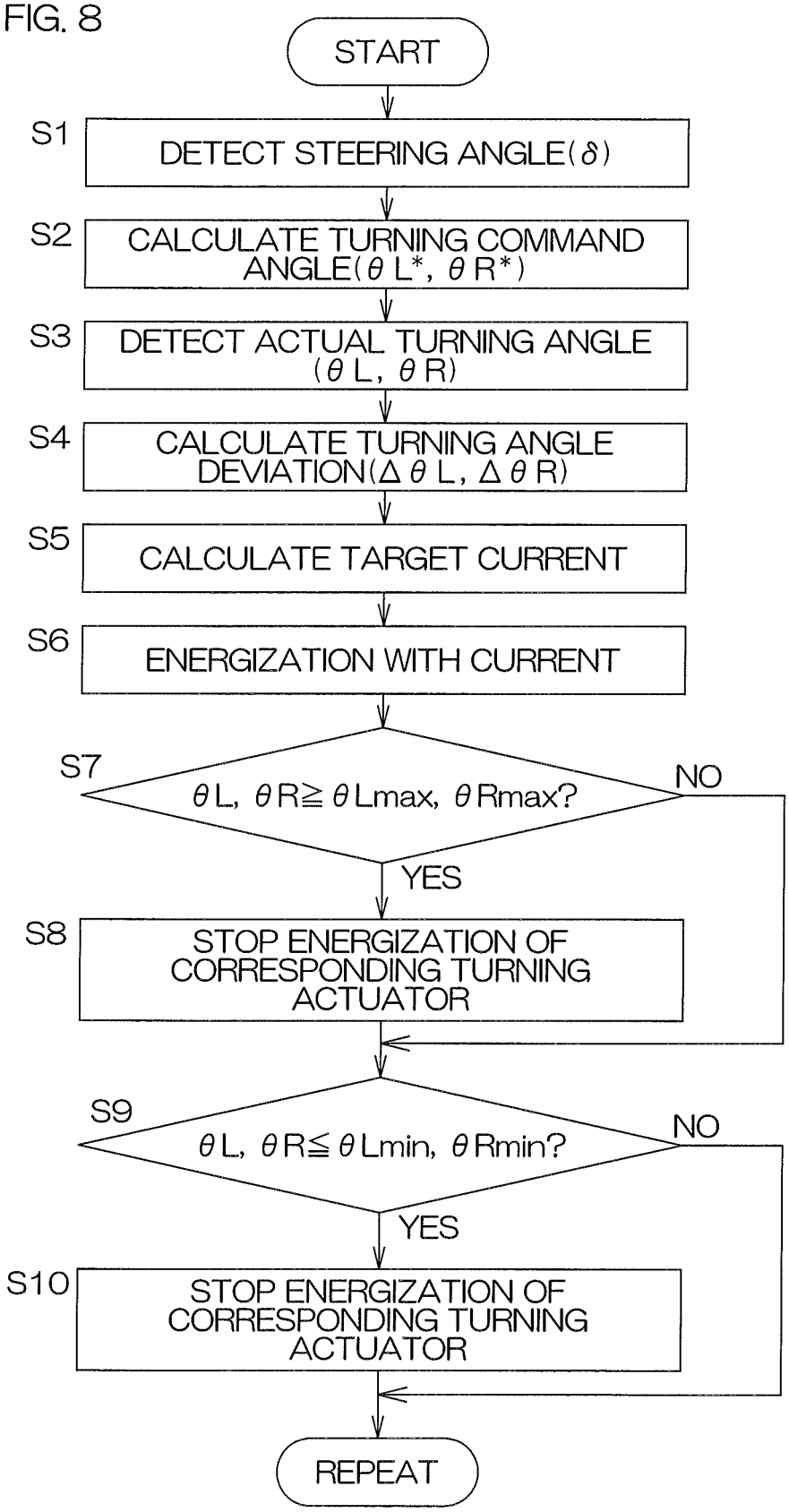
FIG. 8 is a flowchart for describing the content of turning angle control.

FIG. 8 is a flowchart for describing turning angle control by the controller 6. The controller 6 acquires a steering angle δ detected by the steering angle sensor 5*b* (step S1), and individually calculates a port turning command angle θL* and a starboard turning command angle θR* based on the acquired steering angle δ (step S2). The port turning command angle θL* and the starboard turning command angle θR* are, as described above, determined according to a port turning command angle map and a starboard turning command angle map, respectively. Further, the controller 6 acquires turning angles θL and θR (actual turning angles) detected by the portside turning angle sensor 30L and the starboard side turning angle sensor 30R (step S3). The portside turning angle sensor 30L and the starboard side turning angle sensor 30R preferably are sensors that output turning angle information with reference to the port turning center line 41L and the starboard turning center line 41R, respectively, for example. In this case, the controller 6 corrects an output signal of the portside turning angle sensor 30L based on the port reference angle αL to determine the port turning angle θL, and corrects an output signal of the starboard side turning angle sensor 30R based on the starboard reference angle αR to determine a starboard turning angle θR. Specifically, a corrected turning angle θL, θR (turning angle with reference to the hull center line 7) is determined by subtracting the corresponding reference angle αL, αR from a relative turning angle (turning angle with reference to the turning center line) detected by each turning angle sensor 30L, 30R.

Further, the controller 6 computes a deviation of the port turning angle θL relative to the port turning command angle θL* (hereinafter, referred to as a "port turning angle deviation") ΔθL (=θL−θL*) (step S4). Similarly, the controller 6 computes a deviation of the starboard turning angle θR relative to the starboard turning command angle θR* (hereinafter, referred to as a "starboard turning angle deviation") ΔθR (=θR−θR*) (step S4). Moreover, the controller 6 calculates a target current of the portside turning actuator 24L based on the port turning angle deviation ΔθL, and calculates a target current of the starboard side turning actuator 24R based on the starboard turning angle deviation ΔθR (step S5). The greater the deviations ΔθL and ΔθR, the greater the target currents. Based on the target currents thus calculated, the controller 6 energizes the portside turning actuator 24L and the starboard side turning actuator 24R to drive those actuators (step S6). By repetition of such operations, feedback control (positional feedback control) to lead the port turning angle θL and the starboard turning angle θR to the port turning command angle θL* and the starboard turning command angle θR*, respectively, is performed.

The controller 6 monitors the turning angles θL and θR detected by the turning angle sensors 30L and 30R, and when the turning angle θL or θR has reached the corresponding upper limit turning angle value θRmax, θRmax (step S7: YES), stops energization of the corresponding turning actuator 24L, 24R (step S8). Further, the controller 6, when the turning angle θL or θR has reached the corresponding lower limit turning angle value θLmin, θRmin (step S9: YES), stops energization of (energy supply to) the corresponding turning actuator 24L, 24R (step S10).

The port turning command angle map and the starboard turning command angle map are registered in advance in the memory 6M. The controller 6 may have a turning command angle map creating function. Specifically, the controller 6 may create a port turning command angle map and a starboard turning command angle map based on the port reference angle αL and the starboard reference angle αR input from the input device 14 (refer to FIG. 4).

The controller 6 may not have the function of creating turning command angle maps. That is, a port turning command angle map and a starboard turning command angle map may be previously created by an information processing device, and those turning command angle maps may be written in the memory 6M via an external connection interface provided in the controller 6.

As mentioned above, according to the present preferred embodiment, the turning center lines 41L and 41R of the portside outboard motor 3L and the starboard side outboard motor 3R mounted on the stern are respectively inclined with respect to the hull center line 7. Specifically, the portside outboard motor 3L and the starboard side outboard motor 3R are disposed in a manner distributed to the left and right of the hull center line 7. Moreover, the portside outboard motor 3L is mounted on the stern in an inclined posture in which the turning center line 41L thereof intersects the hull enter line 7 from the left side at a position further to the front than the turning center of the portside outboard motor 3L. The starboard side outboard motor 3R is mounted on the stern in an inclined posture in which the turning center line 41R thereof intersects the hull enter line 7 from the right side at a position further to the front than the turning center of the starboard side outboard motor 3R. Accordingly, when the hull 2 turns, the outboard motor positioned on the inner side with respect to the turning direction of the hull 2 preferably has a great turning angle in a turning direction corresponding to the turning direction of the hull 2, and as a result, applies a great moment toward the hull turning direction to the hull 2. The turning performance of the hull 2 is thus significantly improved. Moreover, because the turning angles of the portside outboard motor 3L and the starboard side outboard motor 3R are individually controlled, a wide variety of hull behavior is realized. For example, the port turning command angle θL* and the starboard turning command angle θR* are capable of being set to values of different signs so as to provide the turning directions of the portside outboard motor 3L and the starboard side outboard motor 3R as opposite directions.

The controller 6 determines the turning command angles θL* and θR* using turning command angle maps according to the port reference angle αL and the starboard reference angle αR. The memory 6M of the controller 6 needs not to have stored the values themselves of the reference angles αL and αR, and it suffices to have stored turning command angle maps in which these reference angles αL and αR are intrinsically present. That is, the turning command angle maps include turning angle control information according to the reference angle αL, αR of each outboard motor 3L, 3R to have turning angle control information containing the reference angle αL, αR. In this manner, the reference angle αL, αR is indirectly stored in the format of a turning command angle map containing a reference angle, and by making reference to the turning command angle maps, turning angle control of the outboard motors 3L and 3R mounted in the inclined manner is appropriately performed. Accordingly, both a wide variety of hull behavior and an improvement in turning performance are achieved.

Also, in the present preferred embodiment, the turning command angles θL* and θR* are set with reference to the turning neutral lines 42L and 42R that represent the turning positions of the portside outboard motor 3L and the starboard side outboard motor 3R when the hull center line 7 and the thrust action lines 11L and 11R become parallel or substantially parallel. Moreover, characteristics of the turning command angles θL* and θR* with respect to the steering angle δ are different between the left and right of the turning neutral line 42L, 42R. More specifically, the turning amount with respect to the steering angle δ is different between the left and right of the turning neutral line 42L, 42R. Also, the rate of change in the turning amount with respect to the steering angle δ is different between the left and right of the turning neutral line 42L, 42R. Accordingly, appropriate turning command angles θL* and θR* are capable of being set in the entire turning angle ranges, so that turning angle control of the portside outboard motor 3L and the starboard side outboard motor 3R mounted in an inclined manner is appropriately performed. Both a wide variety of hull behavior and an improvement in turning performance are thus achieved.

Also, in the present preferred embodiment, the upper limit port turning command angle value θL*max (maximum right turning command angle) and the lower limit port turning command angle value θL*min (maximum left turning command angle) are different in absolute value. Similarly, the upper limit starboard turning command angle value θR*max (maximum right turning command angle) and the lower limit starboard turning command angle value θR*min (maximum left turning command angle) are different in absolute value. Accordingly, appropriate turning angle control is performed according to the physical turning limitations in the right direction and left direction.

In the present preferred embodiment, when the steering angle δ=0 (neutral steering command), the outboard motors 3L and 3R take straight traveling postures in which these are parallel or substantially parallel in direction to the hull center line 7. Thus, even if the mounting angle with respect to the stern is inclined, when making the hull 2 travel straight, the outboard motors 3L and 3R are controlled to turning positions to receive less resistance from water. Accordingly, the hull 2 is made to travel straight in a state of less energy loss.

The outboard motor 3L, 3R includes the front portion 35 opposed to the stern, and the wide portion 36 that is disposed further to the rear than the front portion 35 and wider than the front portion 35. When a plurality of outboard motors have a short mounting pitch therebetween, there is a possibility that the wide portions of the plurality of outboard motors interfere with each other and the respective outboard motors are limited in their turning angle ranges. Therefore, in the present preferred embodiment, the outboard motors 3L and 3R preferably are mounted in inclined postures with respect to the stern, and the respective outboard motors 3L and 3R are individually controlled in turning angle. Accordingly, the limitation in the turning angle ranges of the respective outboard motors 3L and 3R is significantly reduced or prevented, so that the turning performance of the vessel 1 is significantly improved, and a wide variety of hull behavior is achieved.

In this manner, the present preferred embodiment provides a vessel propulsion system and a vessel 1 that is significantly improved in turning performance without sacrificing a wide variety of vessel behavior.

Figure 9A:
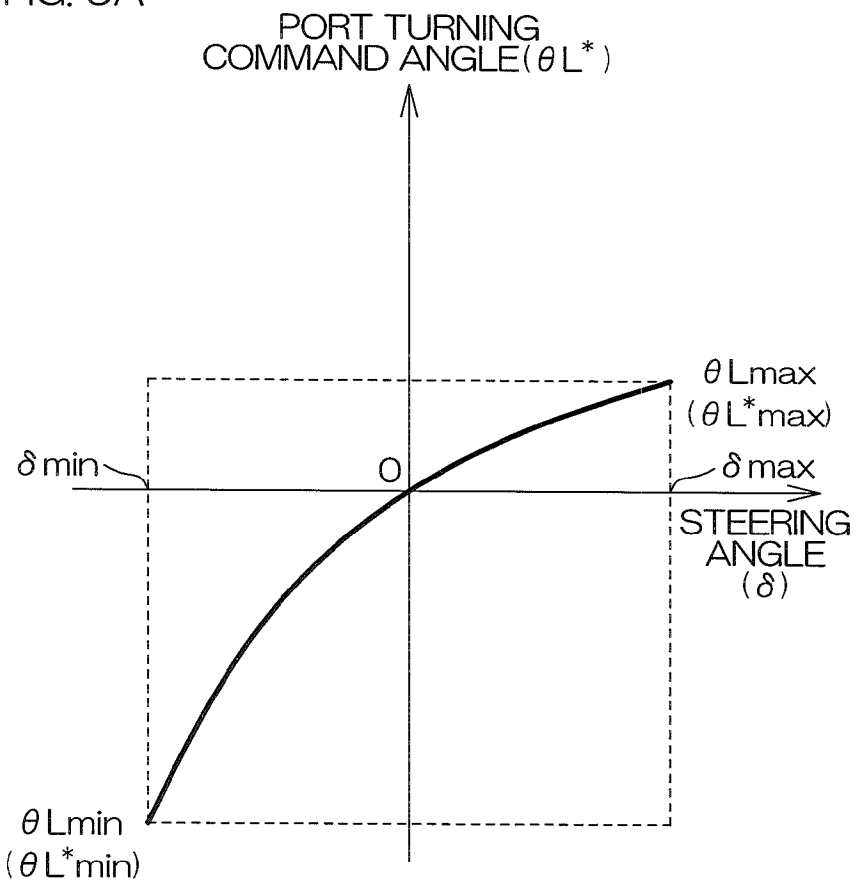
FIG. 9A and FIG. 9B are views for describing a second preferred embodiment of the present invention, and show other examples of the turning command angle map.
Figure 9B:
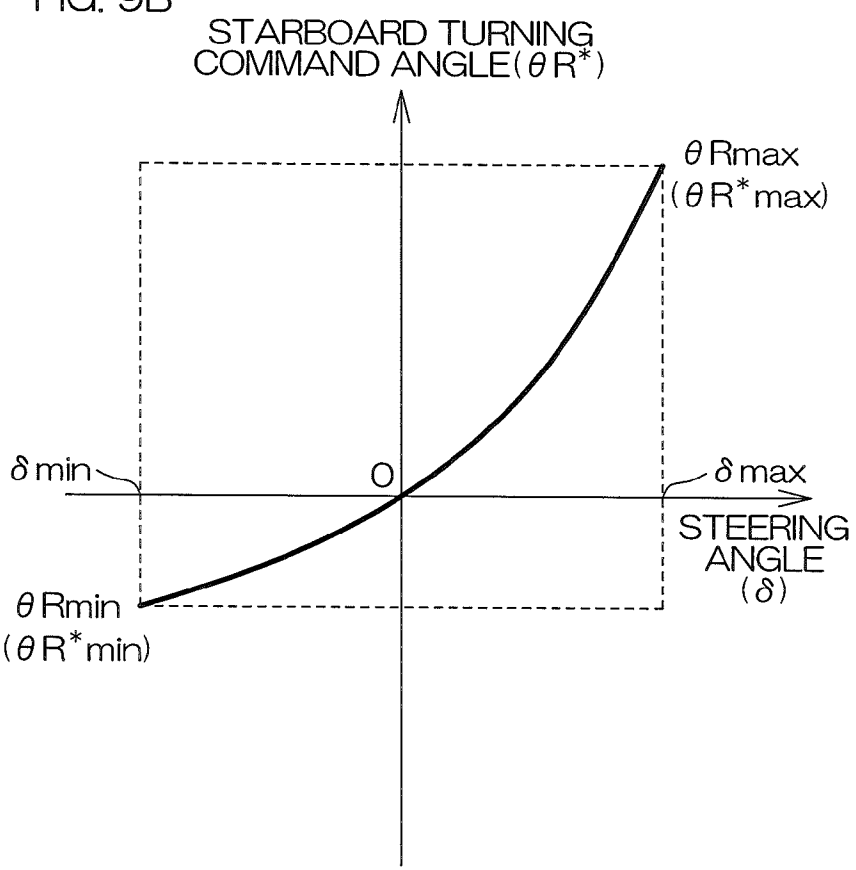

FIG. 9A and FIG. 9B are views for describing a second preferred embodiment of the present invention, and show other examples of the turning command angle map. In the description of the present preferred embodiment, FIG. 1 to FIG. 8 described above are again referred to. In the turning command angle maps shown in FIG. 5A and FIG. 5B, there are characteristics in polygonal line shapes for which turning command angle characteristic lines in the positive steering angle region and negative steering angle region respectively form straight lines and become discontinuous at the steering angle δ=0. In contrast thereto, a port turning command angle characteristic line shown in FIG. 9A and a starboard turning command angle characteristic line shown in FIG. 9B both have curve shapes that are continuous even at the steering angle δ=0.

More specifically, the port turning command angle characteristic line shown in FIG. 9A is defined by a smooth curve that is convex upward, into which the turning command angle characteristic line shown in FIG. 5A has been approximated. The port turning command angle characteristic line makes the lower limit steering angle δmin correspond to the lower limit turning angle value θLmin, makes the upper limit steering angle δmax correspond to the upper limit turning angle value θLmax, and makes the steering neutral position (δ=0) correspond to the turning neutral position (θL*=0). Moreover, it defines characteristics with which the port turning command angle θL* monotonously (nonlinearly) increases according to the increase in the steering angle δ. The rate of increase of the port turning command angle θL* in the negative steering angle region is generally greater than the rate of increase of the port turning command angle θL* in the positive steering angle region.

Similarly, the starboard turning command angle characteristic line shown in FIG. 9B is defined by a smooth curve that is convex downward, into which the turning command angle characteristic line shown in FIG. 5B has been approximated. The starboard turning command angle characteristic line makes the lower limit steering angle δmin correspond to the lower limit turning angle value θRmin, makes the upper limit steering angle δmax correspond to the upper limit turning angle value θRmax, and makes the steering neutral position (δ=0) correspond to the turning neutral position (θR*=0). Moreover, it defines characteristics with which the starboard turning command angle θR* monotonously (nonlinearly) increases according to an increase in the steering angle δ. The rate of increase of the starboard turning command angle θR* in the negative steering angle region is generally smaller than the rate of increase of the starboard turning command angle θR* in the positive steering angle region.

In these turning command angle maps, because no discontinuation of the turning command angle θL*, θR* occurs at the steering angle δ=0, a sudden change in the turning angle deviation ΔθL, ΔθR can be reduced, and as a result, the turning actuator 24 is reduced in current.

In a region near the lower limit turning angle value θLmin of the port turning command angle characteristic line, the rate of change in the turning command angle θL* is relatively great. Also, in a region near the upper limit turning angle value θRmax of the starboard turning command angle characteristic line, the rate of change in the turning command angle θR* is relatively great. However, these regions are regions with a large steering angle δ, and are therefore regions that are preferably used only in a low-speed traveling state. In most of the traveling time of the vessel 1, because the vessel 1 is made to travel at a high speed, a current consumption caused by great changes in the turning command angle in the large-steering angle regions does not really matter. Thus, by reducing a current consumption in the vicinity of the steering angle δ=0 (the vicinity of the steering neutral position), energy saving performance is effectively improved.

Figure 10B:
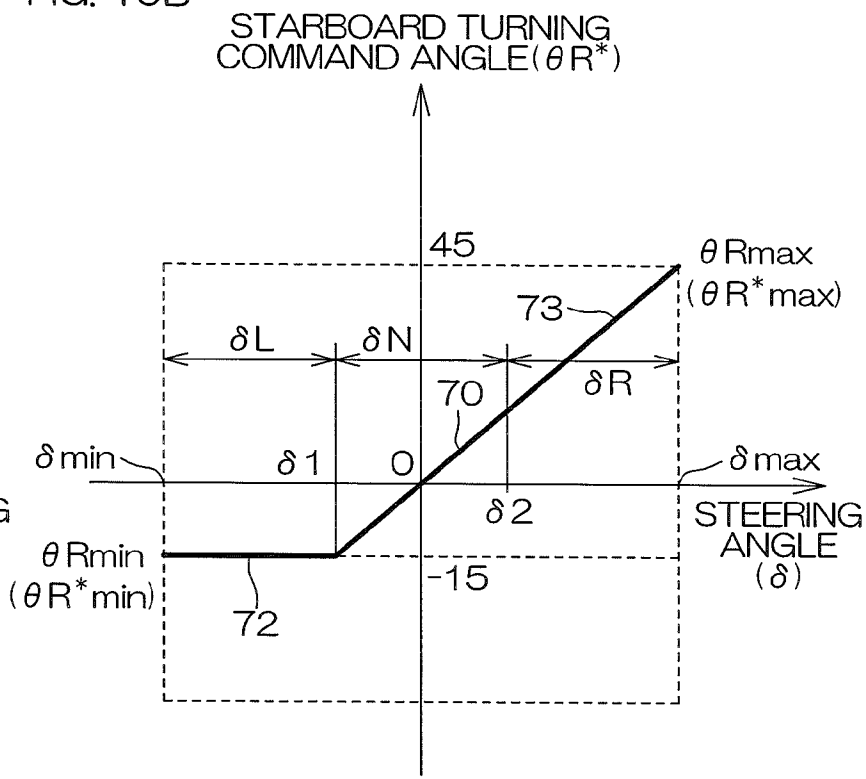
FIG. 10A and FIG. 10B are views for describing a third preferred embodiment of the present invention, and show other examples of the turning command angle map.
Figure 10A:
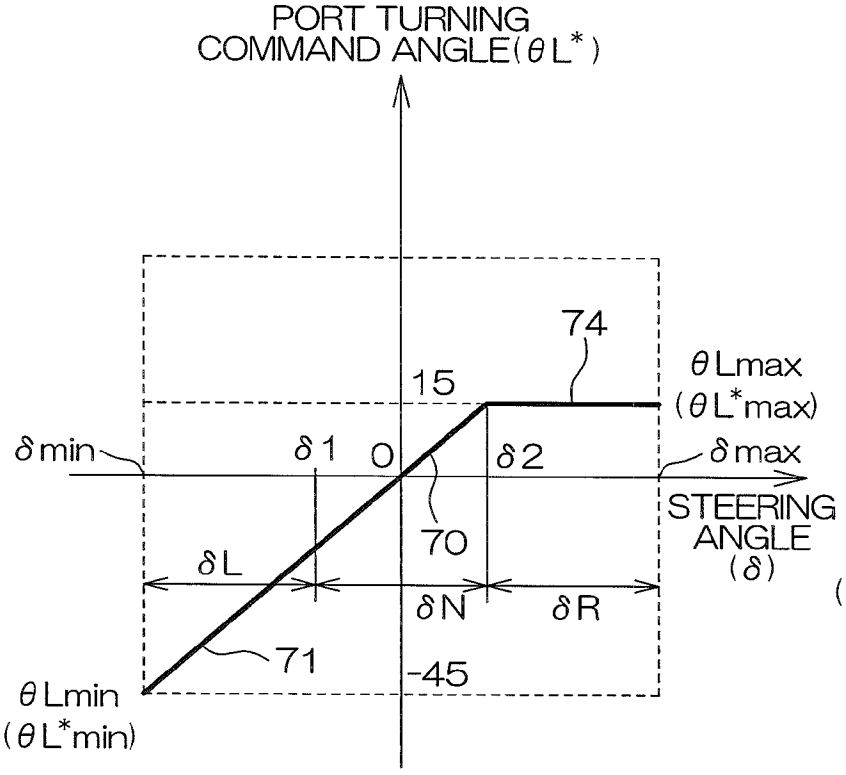

FIG. 10A and FIG. 10B are views for describing a third preferred embodiment of the present invention, and show other examples of the turning command angle map. In the description of the present preferred embodiment, FIG. 1 to FIG. 8 described above are again referred to. In the turning command angle maps shown in FIG. 5A and FIG. 5B, the rate of change of the port turning command angle θL* with respect to the steering angle δ and the rate of change of the starboard turning command angle θR* with respect to the steering angle δ are different in substantially the entire steering angle ranges. In contrast thereto, in the present preferred embodiment, within a central steering angle range δN including the steering neutral position (steering angle δ=0°), the port turning command angle θL* and the starboard turning command angle θR* take equal or substantially equal values, and are also equal or substantially equal in the rate of change with respect to the steering angle δ. More specifically, the port turning command angle characteristics and the starboard turning command angle characteristics follow a straight line 70 sloping upward toward the right drawn with a predetermined inclination such that the turning command angle θL*=θR*=0° when the turning angle δ=0°. The central steering angle range δN, in the present preferred embodiment, is a range from a steering angle threshold δ1 corresponding to the lower limit starboard turning angle value θRmin (for example, −15° on the straight line 70 to a steering angle threshold δ2 corresponding to the upper limit port turning angle value θLmax (for example, 15°) on the straight line 70.

In a left steering angle range δL on the left side relative to the central steering angle range δN, the port turning command angle characteristics are defined by an extension line 71 of the port turning command angle characteristic line (straight line 70) in the central steering angle range δN. Moreover, the port turning command angle characteristics take the lower limit port turning angle value θLmin at the lower limit steering angle δmin (left end steering angle). On the other hand, in the left steering angle range δL, the starboard turning command angle characteristics are defined by a straight line 72 continuous from the left end of the starboard turning command angle characteristic line (70) in the central steering angle range δN and parallel or substantially parallel to the coordinate axis of the steering angle δ. That is, in the left steering angle range δL, the starboard turning command angle θR* is fixed at the lower limit starboard turning angle value θRmin.

Ina right steering angle range δR on the right side relative to the central steering angle range δN, the starboard turning command angle characteristics are defined by an extension line 73 of the starboard turning command angle characteristic line (straight line 70) in the central steering angle range δN. Moreover, the starboard turning command angle characteristics take the upper limit starboard turning angle value θRmax at the upper limit steering angle δmax (right end steering angle). On the other hand, in the right steering angle range δR, the port turning command angle characteristics are defined by a straight line 74 continuous from the right end of the port turning command angle characteristic line (straight line 70) in the central steering angle range δN and parallel or substantially parallel to the coordinate axis of the steering angle δ. That is, in the right steering angle range δR, the port turning command angle θL* is fixed at the upper limit port turning angle value θLmax.

Figure 11B:
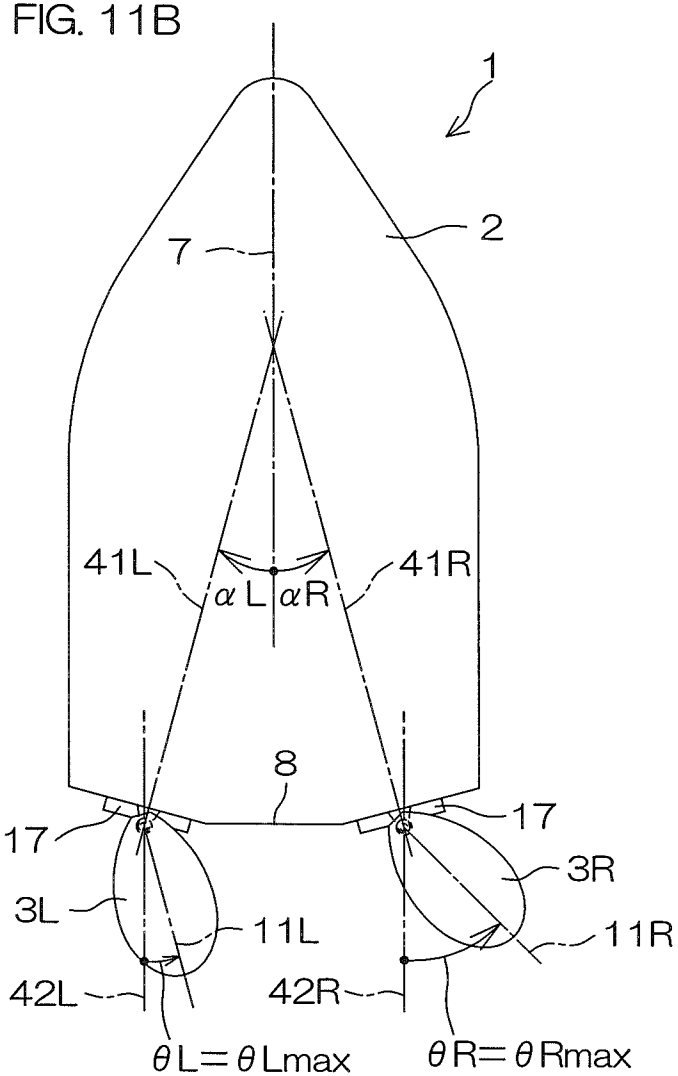
FIG. 11A and FIG. 11B are plan views illustrating turning angle control according to the turning command angle maps shown in FIG. 10A and FIG. 10B.
Figure 11A:
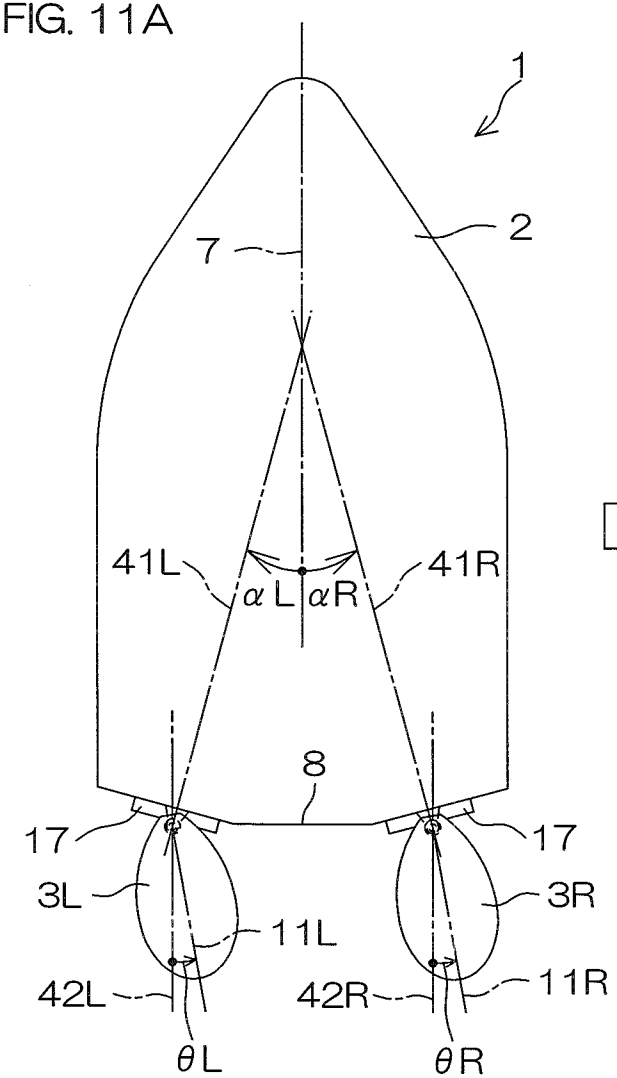

FIG. 11A and FIG. 11B are plan views illustrating turning angle control according to the turning command angle maps shown in FIG. 10A and FIG. 10B, and show a state when the left and right outboard motors 3L and 3R are turned to the right side to turn the vessel 1 to the right side. In the central steering angle range δN, as shown in FIG. 11A, the turning angles θL and θR of the left and right outboard motors 3L and 3R are kept equal or substantially equal. When steered further to the right side beyond the central steering angle range δN, the portside outboard motor 3L is fixed at the upper limit port turning angle value θLmax, only the starboard side outboard motor 3R is turned further to the right side to reach the upper limit starboard turning angle value θRmax greater than the upper limit port turning angle value θLmax. This state is shown in FIG. 11B. At this time, the starboard turning angle θR is greater than the port turning angle θL by a sum (αL+αR) of the port reference angle αL and the starboard reference angle αR.

When the port turning command angle θL* has reached the upper limit port turning command angle value θL*max with an increase in the steering angle δ, the controller 6 keeps the port turning command angle θL* unchanged at the upper limit port turning command angle value θL*max even if the steering angle δ further increases. Moreover, when the port turning angle θL becomes not less than the upper limit port turning angle value θLmax, the controller 6 stops energization of (energy supply to) the portside turning actuator 24L (steps S7 and S8 of FIG. 8). Accordingly, the port turning angle θL =θLmax is maintained. Similarly, when the starboard turning command angle θR* has reached the lower limit starboard turning command angle value θR*min with a decrease in the steering angle δ, the controller 6 keeps the starboard turning command angle θR* unchanged at the lower limit starboard turning command angle value θR*min even if the steering angle δ further decreases. Moreover, when the starboard turning angle θR becomes not more than the lower limit starboard turning angle value θRmin, the controller 6 stops energization of (energy supply to) the portside turning actuator 24R (steps S7 and S8 of FIG. 8). Accordingly, the starboard turning angle θR=θRmin is maintained.

Such control preferably is also performed based on the steering angle δ. Specifically, in the case where a limited rotation type steering wheel 5*a* is provided, when the steering angle δ increases and has reached the steering angle threshold δ2 at the right end of the central steering angle range δN, the controller 6 keeps the port turning command angle θL* unchanged at the upper limit port turning command angle value θL*max even if the steering angle δ further increases. Moreover, when the port turning angle θL becomes not less than the upper limit port turning angle value θLmax, the controller 6 stops energization of the portside turning actuator 24L. Similarly, when the steering angle δ decreases and has reached the steering angle threshold δ1 at the left end of the central steering angle range δN, the controller 6 keeps the starboard turning command angle θR* unchanged at the lower limit starboard turning command angle value θR*min even if the steering angle δ further degreases. Moreover, when the starboard turning angle θR becomes not more than the lower limit starboard turning angle value θRmin, the controller 6, stops energization of the starboard side turning actuator 24R.

In the case where an unlimited rotation type steering wheel 5*a* is provided, when the steering angle δ becomes not less than the steering angle threshold δ2 at the right end of the central steering angle range δN, the controller 6 keeps the port turning command angle θL* unchanged at the upper limit port turning command angle value θL*max. Moreover, when the port turning angle θL becomes not less than the upper limit port turning angle value θLmax, the controller 6 stops energization of the portside turning actuator 24L. Also, when the steering angle δ becomes a value not less than the value δmax at the right end of the right steering angle range δR, the controller 6 keeps the starboard turning command angle θR* unchanged at the upper limit starboard turning command angle value θR*max. Moreover, when the starboard turning angle θR becomes not less than the upper limit starboard turning angle value θRmax, the controller 6 stops energization of the starboard side turning actuator 24R. In this case, the portside outboard motor 3L is positioned on the outer side with respect to the turning direction (right direction) of the hull 2, and the starboard side outboard motor 3R is positioned on the inner side with respect to the turning direction of the hull 2.

Similarly, when the steering angle δ becomes not more than the steering angle threshold δ1 at the left end of the central steering angle range δN, the controller 6 keeps the starboard turning command angle θR* unchanged at the lower limit starboard turning command angle value θR*min. Moreover, when the starboard turning angle θR becomes not more than the lower limit starboard turning angle value θRmin, the controller 6 stops energization of the starboard side turning actuator 24R. Also, when the steering angle δ becomes a value not more than the value δmin at the left end of the left steering angle range δL, the controller 6 keeps the port turning command angle θL* unchanged at the lower limit port turning command angle value θL*min. Moreover, when the port turning angle θL becomes not more than the lower limit port turning angle value θLmin, the controller 6 stops energization of the portside turning actuator 24L. In this case, the starboard side outboard motor 3R is positioned on the outer side with respect to the turning direction (left direction) of the hull 2, and the portside outboard motor 3L is positioned on the inner side with respect to the turning direction of the hull 2.

As mentioned above, in the present preferred embodiment, when the steering angle δ increases and the port turning command angle θL* has reached its upper limit value θL*max, the port turning command angle θL* is kept at the upper limit value θL*max with respect to a further increased steering angle δ. Moreover, energization of the portside turning actuator 24L is stopped. On the other hand, when the steering angle δ decreases and the starboard turning command angle θR* has reached its lower limit value θR*min, the starboard turning command angle θR* is kept at the lower limit value θR*min with respect to a further decreased steering angle δ. Moreover, energization of the starboard side turning actuator 24R is stopped. Because appropriate turning angle control is thus performed, both a wide variety of hull behavior and an improvement in turning performance is achieved. Also, a wasteful energy supply is avoided, while appropriate turning control of the outboard motors 3L and 3R mounted in an inclined manner on the stern is reliably performed.

Figure 12B:
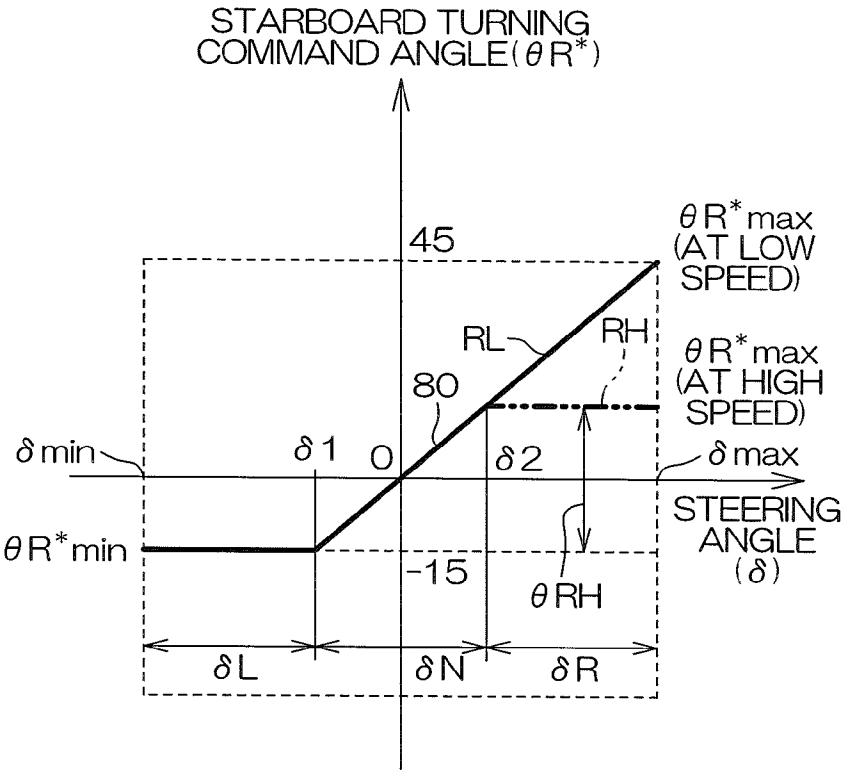
FIG. 12A and FIG. 12B are views for describing a fourth preferred embodiment of the present invention, and show other examples of the turning command angle map.
Figure 12A:
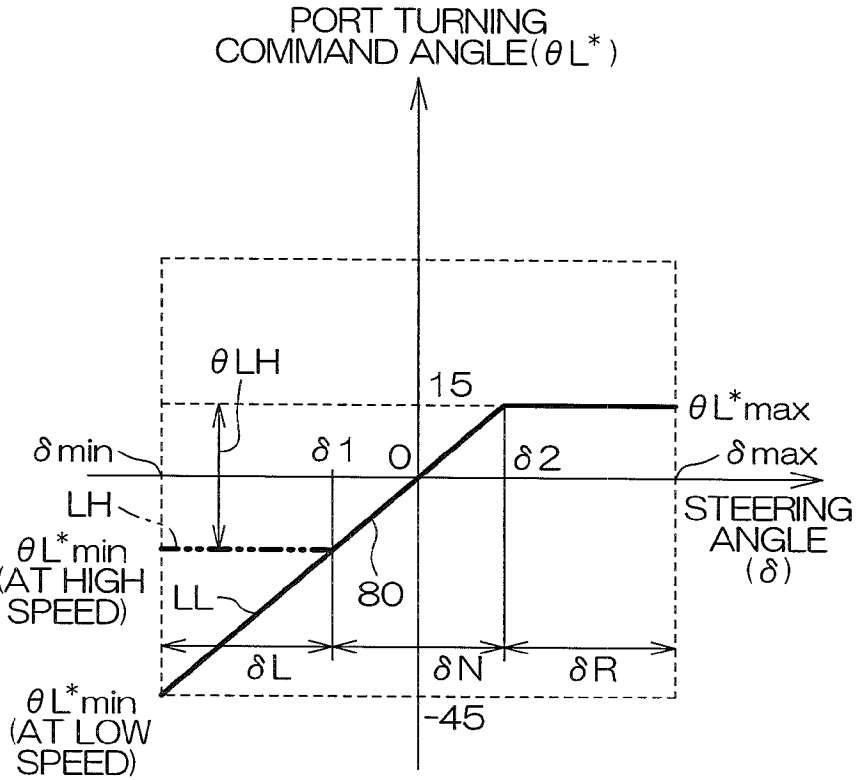

FIG. 12A-12C are views for describing a fourth preferred embodiment of the present invention, and show other examples of the turning command angle map. In the description of the present preferred embodiment, FIG. 1 to FIG. 8 and FIG. 10A and FIG. 10B described above are again referred to. In the present preferred embodiment, turning command angle characteristics are changed between a high-speed traveling state and a low-speed traveling state. Specifically, in the low-speed traveling state, the turning command angles θL* and θR* are set according to the same characteristics as those shown in FIG. 10A and FIG. 10B. In the high-speed traveling state, the turning command angles θL* and θR* of the portside and starboard side outboard motors 3L and 3R are limited to high-speed traveling turning angle ranges θLH and θRH corresponding to the central steering angle range δN, respectively.

Thus, a portside turning command angle characteristic line LL (hereinafter, referred to as a "port low-speed characteristic line LL," shown by a solid line in FIG. 12A) that is applied in the low-speed traveling state is the same as the characteristic line in FIG. 10A. Also, a starboard turning command angle characteristic line RL (hereinafter, referred to as a "starboard low-speed characteristic line RL," shown by a solid line in FIG. 12B) that is applied in the low-speed traveling state is the same as the characteristic line in FIG. 10B. On the other hand, a portside turning command angle characteristic line LH (hereinafter, referred to as a "port high-speed characteristic line LH," shown by an alternate long and two short dashed line in FIG. 12A) that is applied in the high-speed traveling state is the same as the port low-speed characteristic line LL in the right steering angle range δR and the central steering angle range δN, and is different from the port low-speed characteristic line LL in the left steering angle range δL. Also, a starboard turning command angle characteristic line RH (hereinafter, referred to as a "starboard high-speed characteristic line RH," shown by an alternate long and two short dashed line in FIG. 12B) that is applied in the high-speed traveling state is the same as the starboard low-speed characteristic line RL in the left steering angle range δL and the central steering angle range δN, and is different from the starboard low-speed characteristic line RL in the right steering angle range δR.

Specifically, as shown in FIG. 12A, the port high-speed characteristic line LH in the left steering angle range δL is defined by a straight line continuous from the left end of a straight line 80 that provides characteristics in the central steering angle range δN and parallel or substantially parallel to the coordinate axis of the steering angle δ. That is, in the left steering angle range δL, the port turning command angle θL* is fixed at a lower limit port turning command angle value θL*min (for example, −15° for high-speed traveling. In the present preferred embodiment, the lower limit port turning command angle value θL*min for high-speed traveling is equal or substantially equal to the lower limit starboard turning command angle value θR*min.

Similarly, as shown in FIG. 12B, the starboard high-speed characteristic line RH in the right steering angle range δR is defined by a straight line continuous from the right end of a straight line 80 that provides characteristics in the central steering angle range δN and parallel or substantially parallel to the coordinate axis of the steering angle δ. That is, in the right steering angle range δR, the starboard turning command angle θR* is fixed at an upper limit starboard turning command angle value θR*max (for example, 15°) for high-speed traveling. In the present preferred embodiment, the upper limit starboard turning command angle value θR*max for high-speed traveling is equal or substantially equal to the upper limit port turning command angle value θL*max.

Due to such an configuration, in the high-speed traveling state, the portside outboard motor 3L and the starboard side outboard motor 3R are kept parallel or substantially parallel, so that water flow resistance is significantly reduced or prevented. That is, when one outboard motor is made to have a turning angle greater than that of the other outboard motor, water pressure concentrates on the outboard motor with a greater turning angle, which results in a great water flow resistance. Therefore, in the present preferred embodiment, the turning angle ranges are limited, in the high-speed traveling state, so as to keep the left and right outboard motors 3L and 3R parallel or substantially parallel. Accordingly, the water flow resistance is significantly reduced or prevented, and power consumption of the turning actuator 24 is significantly reduced or minimized.

The high-speed traveling state may be, specifically, in a state of traveling at a speed such that the vessel 1 is brought into a smooth traveling state (planing state). Because the speed of the vessel 1 corresponds or substantially corresponds to the engine speed of the outboard motor 3, the turning command angle characteristics may be switched according to the engine speed of the outboard motor 3. Alternatively, the turning command angle characteristics may be switched according to an output signal of the speed sensor 33 (refer to FIG. 4) that detects the speed of the vessel 1.

Figure 13:
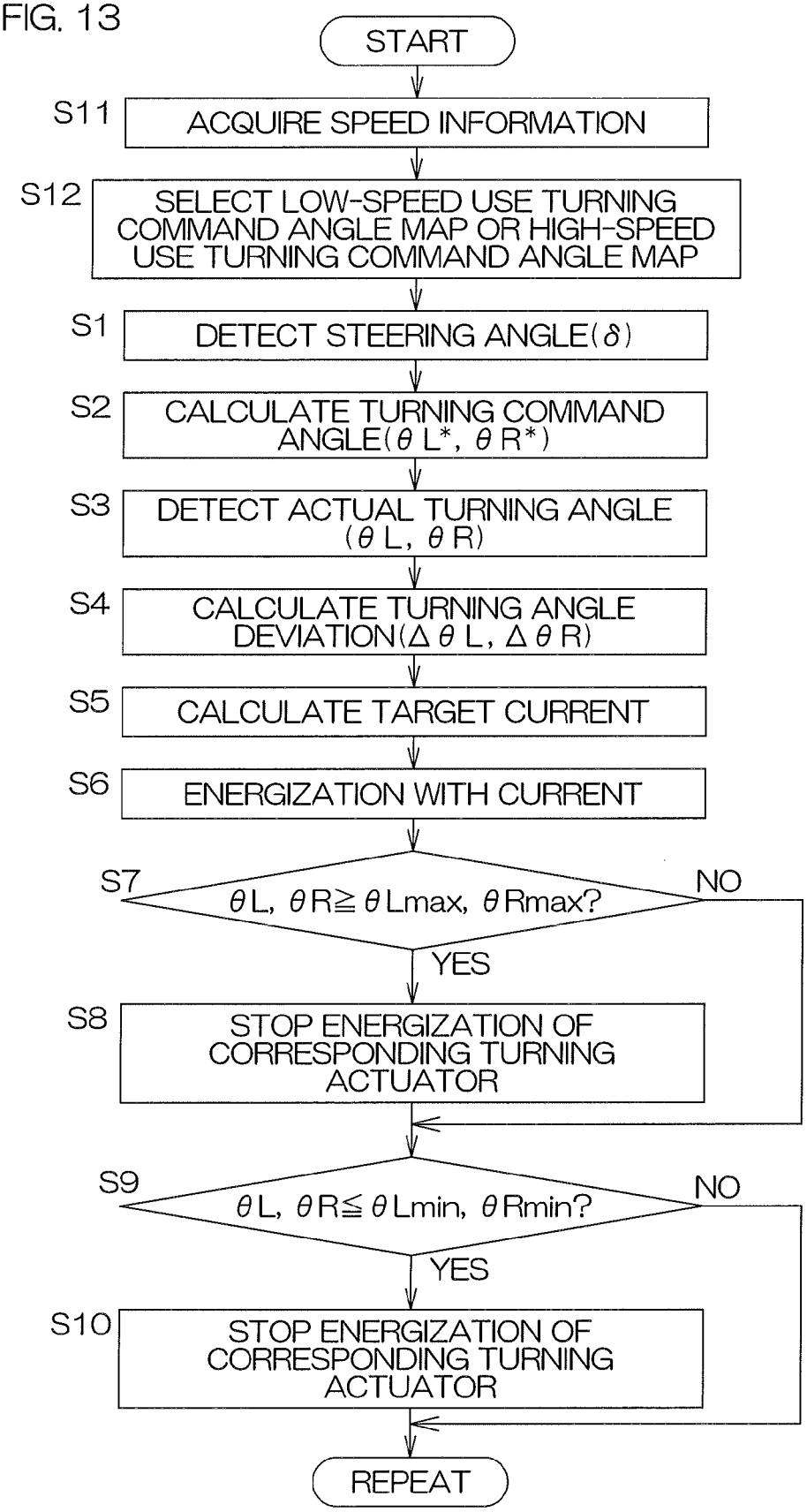
FIG. 13 is a flowchart for describing turning angle control by the fourth preferred embodiment of the present invention.

FIG. 13 is a flowchart for describing turning angle control by the controller 6. In FIG. 13, steps in which the same processes as those in the respective steps shown in FIG. 8 described above will be denoted by the same reference signs, and descriptions thereof will be omitted.

In the present preferred embodiment, the controller 6 acquires speed information of the vessel 1 (step S11), and selects low-speed use turning command angle maps (corresponding to the low-speed characteristic lines LL and RL of FIG. 12A and FIG. 12B) or high-speed use turning command angle maps (corresponding to the high-speed characteristic lines LH and RH of FIG. 12A and FIG. 12B) based on the speed information (step S12). More specifically, if the speed information of the vessel 1 is not more than a predetermined switching threshold, low-speed use turning command angle maps (low-speed use maps) are selected. If the speed information of the vessel 1 is over the above-mentioned switching threshold, high-speed use turning command angle maps (high-speed use maps) are selected. However, hysteresis may be introduced for switching of turning command angle maps. That is, if the currently selected turning command angle maps are low-speed use maps, the selection state of the low-speed use maps is continued if the speed information of the vessel 1 is not more than a first threshold, and the low-speed use maps are switched to high-speed use maps if the speed information of the vessel 1 exceeds the first threshold. On the other hand, if the currently selected turning command angle maps are high-speed use maps, the selection state of the high-speed use maps is continued if the speed information of the vessel 1 is over a second threshold smaller than the first threshold, and the high-speed use maps are switched to low-speed use maps if the speed information of the vessel 1 becomes not more than the second threshold.

The controller 6 determines a port turning command angle θL* and a starboard turning command angle θR* corresponding to a steering angle δ (steps S1 and S2) based on the turning command angle maps thus selected. Subsequent processes are the same as those in the case of the first preferred embodiment. However, for the processes in steps S7 to S10, prior to these processes, it is preferable to have substituted the upper limit turning command angle values θL*max and θR*max and the lower limit turning command angle values θL*min and θR*min provided in selected turning command angle maps for the upper limit turning angle values θLmax and θRmax and the lower limit turning angle values θLmin and θRmin, respectively. Because energization of the turning actuator 24 is accordingly be reduced, energy saving performance is significantly improved or maximized.

The speed information of the vessel 1 may be an engine speed that is determined based on an output of the engine rotation detection unit 34. In this case, the threshold for switching between low-speed use maps and high-speed use maps may be on the order of about 4000 rpm, for example. The speed information of the vessel 1 may be a speed of the vessel 1 that is detected by the speed sensor 33, for example.

The switching between low-speed use maps and high-speed use maps is, in the present preferred embodiment, as can be understood from FIGS. 12A and 12B, the switching between the lower limit port turning command angle value θL*min (upper limit value of a leftward turning command angle) and the upper limit starboard turning command angle value θR*max (upper limit value of a rightward turning command angle). Thus, the controller 6 has a function as an upper limit turning angle setting unit that variably sets the upper limit turning angles (θR*max and θL*min).

Figure 14A:
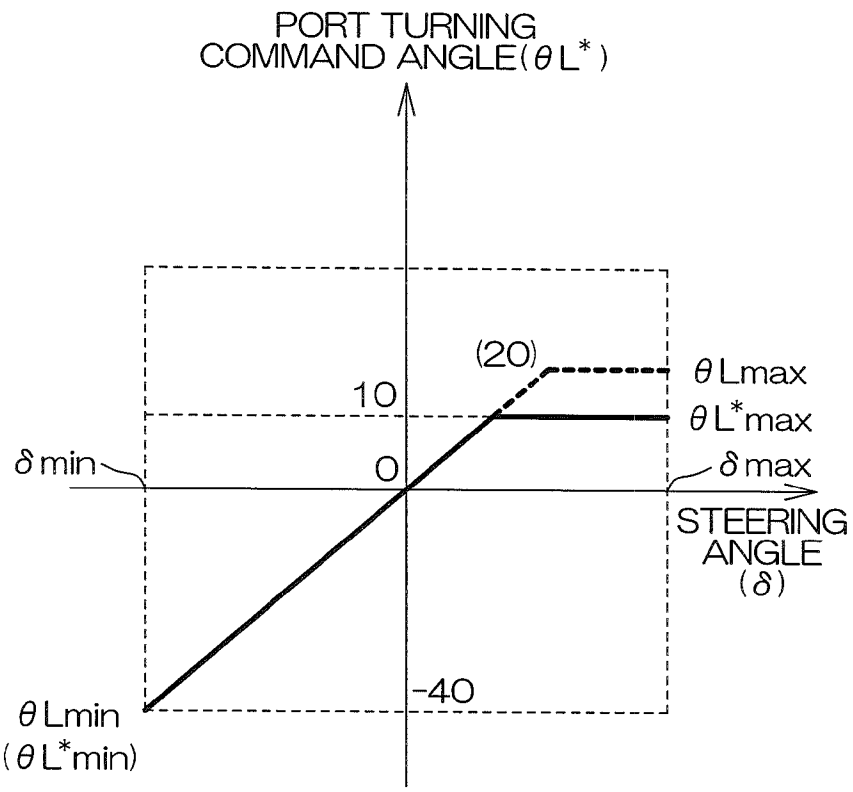
FIG. 14A and FIG. 14B are views for explaining a fifth preferred embodiment of the present invention, and show examples of a turning command angle map.
Figure 14B:
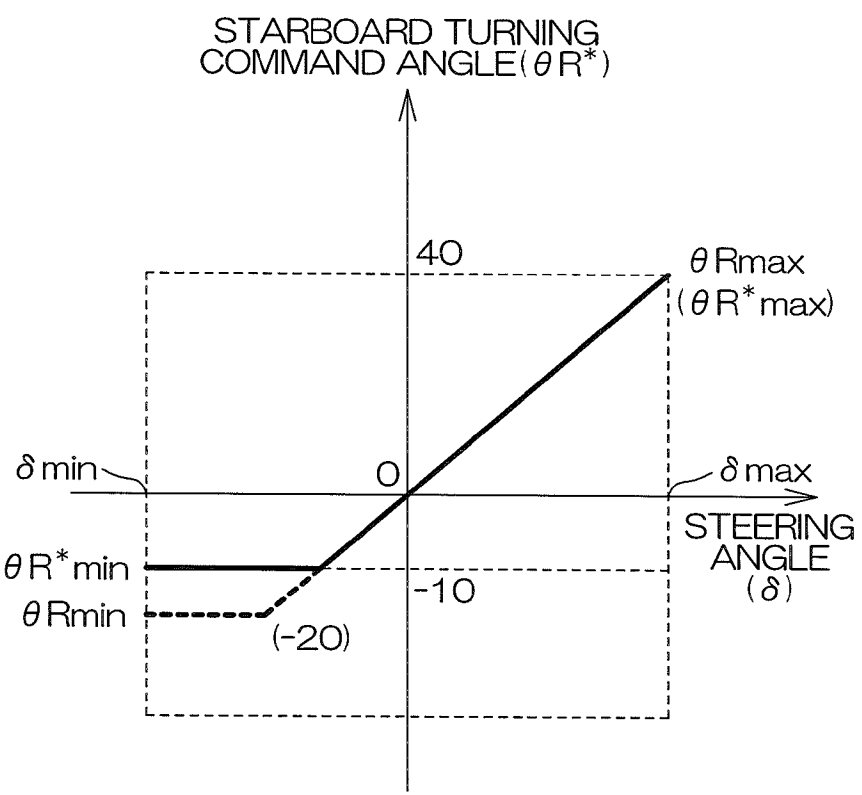

FIG. 14A and FIG. 14B are views for describing a fifth preferred embodiment of the present invention. In the description of the present preferred embodiment, FIG. 1 to FIG. 8 and FIG. 10A and FIG. 10B described above are again referred to. In the present preferred embodiment, the same turning command angle characteristics as those in FIG. 10A and FIG. 10B are used, but a lower limit turning command angle value and an upper limit turning command angle value are capable of being variably set such that absolute values thereof are not more than absolute values of a lower limit turning angle value and an upper limit turning angle value defined by structural limitations of the outboard motor 3 and the turning mechanism 4. For example, in a speed boat or the like having a slender hull, because the hull 2 has a small width, interference between the outboard motors 3L and 3R may occur, and for this reason, it becomes necessary to set the respective absolute values of the upper limit turning command angle value θL*max of the portside outboard motor 3L and the lower limit turning command angle value θR*min of the starboard side outboard motor 3R small in some cases. Therefore, in the present preferred embodiment, the upper limit port turning command angle value θL*max and the lower limit starboard turning command angle value θR*min are variably settable.

Specifically, FIG. 14A shows an example in which the upper limit port turning angle value θLmax due to structural limitations of the portside outboard motor 3L and the portside turning mechanism 4L is −20°. In this case, for avoiding interference with the starboard side outboard motor 3R and other purposes, the upper limit port turning command angle value θL*max may be set to a value smaller than the upper limit port turning angle value θLmax, for example, 10°. Similarly, FIG. 14B shows an example in which the lower limit starboard turning angle value θRmin due to structural limitations of the starboard side outboard motor 3R and the starboard side turning mechanism 4R is −20°. In this case, for avoiding interference with the portside outboard motor 3L and other purposes, the lower limit starboard turning command angle value θR*min may be set to a value smaller in absolute value than the lower limit starboard turning angle value θRmin, for example, −10°.

The lower limit port turning command angle value θL*min and the upper limit starboard turning command angle value θR*max may also be variably settable. In the examples of FIG. 14A and FIG. 14B, θL*min=θLmin and θR*max=θRmax.

Figure 15:
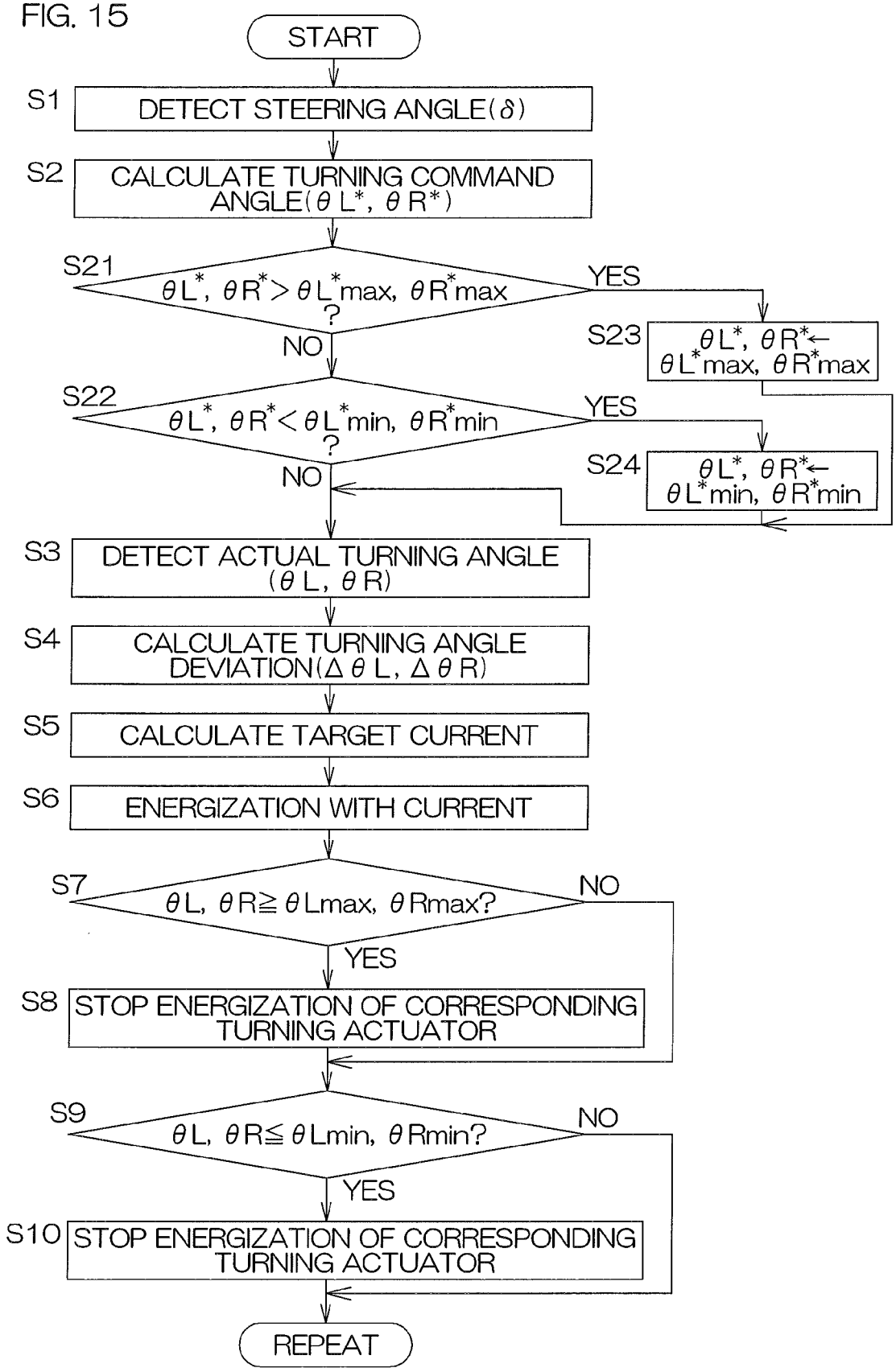
FIG. 15 is a flowchart for describing turning angle control by the fifth preferred embodiment of the present invention.

FIG. 15 is a flowchart for describing turning angle control by the controller 6. In FIG. 15, steps in which the same processes as those in the respective steps shown in FIG. 8 described above will be denoted by the same reference signs, and descriptions thereof will be omitted.

The controller 6 has a function of setting the upper limit turning command angle value θL*max, θR*max and the lower limit turning command angle value θL*min, θR*min of each outboard motor 3. Specifically, the controller 6 sets the upper limit turning command angle value θL*max, θR*max and the lower limit turning command angle value θL*min, θR*min of each outboard motor 3 based on information input from the input device 14. The information necessary for setting the upper limit turning command angle value θL*max, θR*max and the lower limit turning command angle value θL*min, θR*min includes the mounting position of the outboard motor 3, the width of the outboard motor 3, the mounting pitch of the outboard motors 3, and the model name of the outboard motor 3. Examples of the mounting position of the outboard motor 3 include the starboard, the port, and the center. The width of the outboard motor 3 is the maximum width in the left-right direction of the outboard motor 3. The mounting pitch of the outboard motors 3 is an interval when a plurality of outboard motors 3 are mounted. A table of arbitrary combinations of such information made to correspond to upper limit turning command angle values θL*max, θR*max and lower limit turning command angle values θL*min, θR*min may be stored in the memory 6M. In this case, the controller 6 can, by making reference to the table based on input information, determine the upper limit turning command angle value θL*max, θR*max and the lower limit turning command angle value θL*min, θR*min of each outboard motor 3. The determined upper limit turning command angle value θL*max, θR*max and the determined lower limit turning command angle value θL*min, θR*min are stored in the memory 6M. Thus, the controller 6 has a function as an upper limit turning angle setting unit that variably sets the upper limit turning angles (θL*max, θR*max and θL*min, θR*min).

The controller 6 acquires a steering angle δ (step S1), and determines turning command angles θL* and θR* of the individual outboard motors 3 by referring to turning command angle maps based on the steering angle δ (step S2). Subsequently, the controller 6 compares the port turning command angle θL* with the upper limit port turning command angle value θL*max (for example, +10 degrees) and the lower limit port turning command angle value θL*min (for example, −40 degrees) (steps S21 and S22). Then, if the port turning command angle θL* is a value between the lower limit port turning command angle value θL*min and the upper limit port turning command angle value θL*max (steps S21 and S22: NO), the controller 6 uses the port turning command angle θL* as it is. If the port turning command angle θL* is over the upper limit port turning command angle value θL*max (step S21: YES), the controller 6 takes the upper limit port turning command angle value θL*max as the port turning command angle θL* (step S23). If the port turning command angle θL* is less than the lower limit port turning command angle value θL*min (step S22: YES), the controller 6 takes the lower limit port turning command angle value θL*min as the port turning command angle θL* (step S24). Similarly, the controller 6 compares the starboard turning command angle θR* with the upper limit starboard turning command angle value θR*max (for example, +40 degrees) and the lower limit starboard turning command angle value θR*min (for example, −10 degrees) (steps S21 and S22). Then, if the starboard turning command angle θR* is a value between the lower limit starboard turning command angle value θR*min and the upper limit starboard turning command angle value θR*max (steps S21 and S22: NO), the controller 6 uses the starboard turning command angle θR* as it is. If the starboard turning command angle θR* is over the upper limit starboard turning command angle value θR*max (step S21: YES), the controller 6 takes the upper limit starboard turning command angle value θR*max as the starboard turning command angle θR* (step S23). If the starboard turning command angle θR* is less than the lower limit starboard turning command angle value θR*min (step S22: YES), the controller 6 takes the lower limit starboard turning command angle value θR*min as the starboard turning command angle θR* (step S24). In this manner, the turning command angles are corrected according to necessity, and the turning command angles θL* and θR* are limited to be between the upper limit turning command angle values θL*max and θR*max and the lower limit turning command angle values θL*min and θR*min individually set for each outboard motor 3. That is, θL*min θL* θL*max and θR*min θR* θR*max are achieved.

After the turning command angles θL* and θR* are thus set, the same operations as those in the first preferred embodiment are performed (steps S3 to S10). However, for the processes in steps S7 to S10, prior to these processes, it is preferable to have substituted the variably set upper limit turning command angle values θL*max and θR*max and the lower limit turning command angle values θL*min and θR*min for the upper limit turning angle values θLmax and θRmax and the lower limit turning angle values θLmin and θRmin, respectively. Because energization of the turning actuator 24 is accordingly reduced, energy saving performance is significantly improved or maximized.

As described above, instead of comparing the turning command angles θL* and θR* with the lower limit turning command angle values θL*min and θR*min and the upper limit turning command angle values θL*max and θR*max, steering angle thresholds corresponding thereto and the steering angle δ preferably are compared so as to limit turning command angles. For example, in the turning command angle maps shown in FIG. 10A and FIG. 10B, the starboard turning command angle θR* no longer degreases when the steering angle δ becomes not more than the steering angle threshold δ1, and the port turning command angle θL* no longer increases when the steering angle δ becomes not less than the steering angle threshold δ2. Therefore, the controller 6 preferably is variably set the steering angle thresholds δ1 and δ2 based on the state of the vessel 1 and limit the turning command angles θL* and θR* based on a comparison of the steering angle δ and the steering angle thresholds δ1 and δ2. In this case, the controller 6 functions as an operation amount threshold setting unit that variably sets thresholds regarding the operation amount (operation amount thresholds) of the steering wheel 5*a*.

Figure 16:
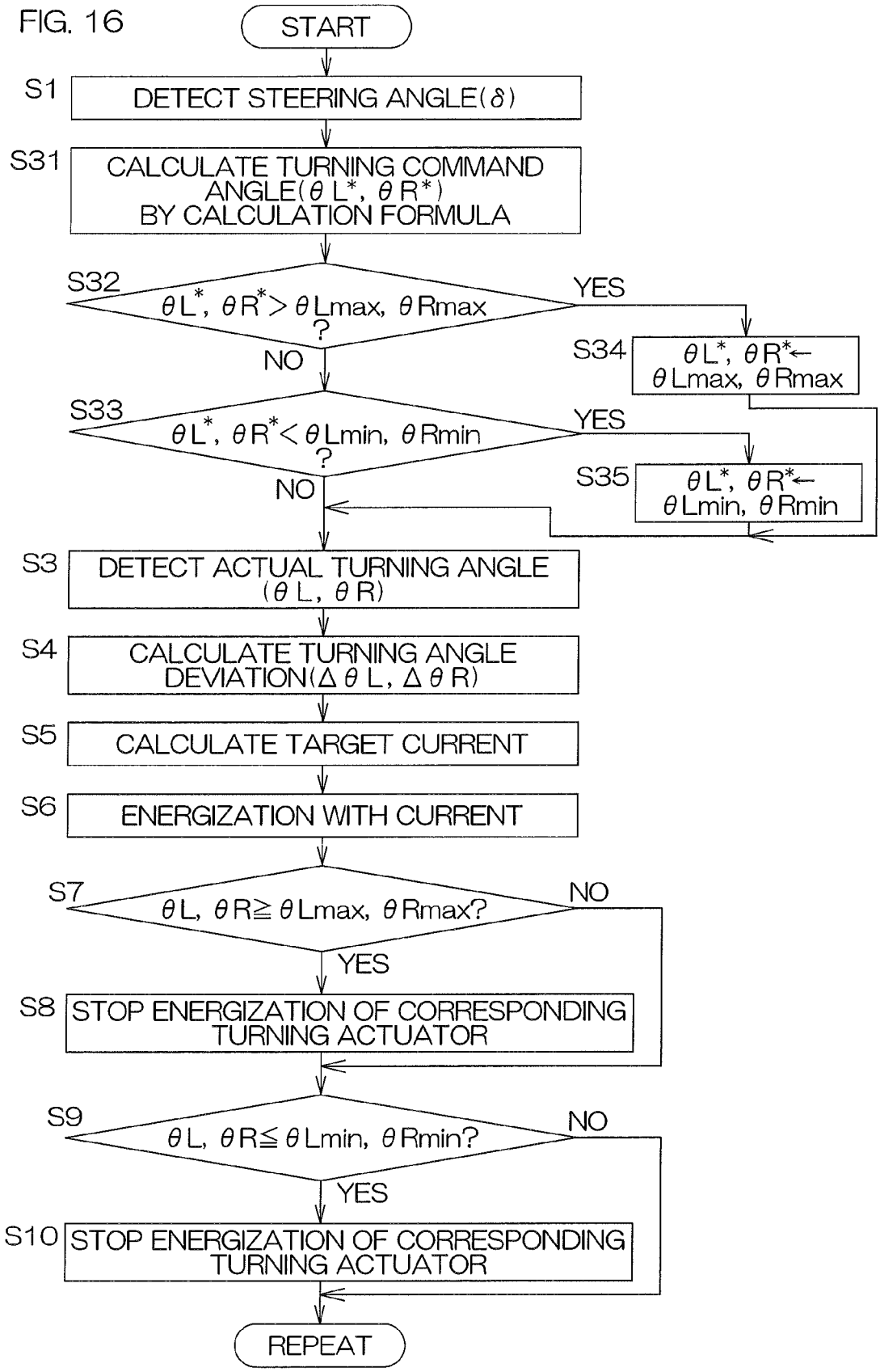
FIG. 16 is a flowchart for describing turning angle control by a sixth preferred embodiment of the present invention.

FIG. 16 is a view for describing a sixth preferred embodiment of the present invention, in which turning angle control to be executed by a controller is shown. In FIG. 16, steps in which the same processes as those in the respective steps shown in FIG. 8 described above will be denoted by the same reference signs, and descriptions thereof will be omitted. FIG. 1 to FIG. 7 are again referred to.

In the first preferred embodiment, the turning command angles θL* and θR* are determined using the turning command angle maps. In contract, in the present preferred embodiment, the controller 6 determines turning command angles θL* and θR* by calculation, without using the turning command angle maps (step S31). Specifically, the controller 6 determines a port turning command angle θL* and a starboard turning command angle θR* according to the following expressions (3) and (4):

$$\text{Port turning command angle } \theta L^* = (\text{Steering angle } \delta / \text{Steering angle ratio}) \quad (3)$$

$$\text{Starboard turning command angle } \theta R^* = (\text{Steering angle } \delta / \text{Steering angle ratio}) \quad (4)$$

The steering angle ratio is a ratio of a change in the steering angle of the steering wheel 5*a* and a change in the turning angle of the outboard motor 3 (steering angle change/turning angle change). For example, where the outboard motor 3 turns 30 degrees when the steering wheel 5*a* is rotated 720 degrees, the steering angle ratio=24 (=720/30). In this case, the port turning command angle θL* and the starboard turning command angle θR* are determined by the following expressions (5) and (6), respectively:

$$\text{Port turning command angle } \theta L^* = (\text{Steering angle } \delta / 24) \quad (5)$$

$$\text{Starboard turning command angle } \theta R^* = (\text{Steering angle } \delta / 24) \quad (6)$$

The controller 6 further compares the port turning command angle θL* with the upper limit port turning angle value θLmax (for example, +15 degrees) and the lower limit port turning angle value θLmin (for example, -45 degrees) (steps S32 and S33). Then, if the port turning command angle θL* is a value between the lower limit port turning angle value θLmin and the upper limit port turning angle value θLmax (steps S32 and S33: NO), the controller 6 uses the port turning command angle θL* as it is. If the port turning command angle θL* is over the upper limit port turning angle value θLmax (step S32: YES), the controller 6 takes the upper limit port turning angle value θLmax as the port turning command angle θL* (step S34). If the port turning command angle θL* is less than the lower limit port turning angle value θLmin (step S33: YES), the controller 6 takes the lower limit port turning angle value θLmin as the port turning command angle θL* (step S35). Similarly, the controller 6 compares the starboard turning command angle θR* with the upper limit starboard turning angle value θRmax (for example, +45 degrees) and the lower limit starboard turning angle value θRmin (for example, −15 degrees) (steps S32 and S33). Then, if the starboard turning command angle θR* is a value between the lower limit starboard turning angle value θRmin and the upper limit starboard turning angle value θRmax (steps S32 and S33: NO), the controller 6 uses the starboard turning command angle θR* as it is. If the starboard turning command angle θR* is over the upper limit starboard turning angle value θRmax (step S32: YES), the controller 6 takes the upper limit starboard turning angle value θRmax as the starboard turning command angle θR* (step S34). If the starboard turning command angle θR* is less than the lower limit starboard turning angle value θRmin (step S33: YES), the controller 6 takes the lower limit starboard turning angle value θRmin as the starboard turning command angle θR* (step S35).

In this manner, the controller 6 sets the port turning command angle θL* and the starboard turning command angle θR* according to the steering angle δ between their respective upper limit values θLmax and θRmax and lower limit values θLmin and θRmin. As a result, the same turning command angle characteristics as the characteristics shown in FIG. 10A and FIG. 10B are achieved.

Of course, the calculation formulas (3) and (4) described above are examples, and the characteristics shown in FIG. 5A and FIG. 5B and the characteristics shown in FIG. 9A and FIG. 9B, etc., can also be realized by calculation. For example, for realizing the characteristics shown in FIG. 5A, it suffices to apply a first steering angle ratio (for example, 720/15) to computation of the port turning command angle θL* in the positive steering angle region, and in the negative steering angle region, to apply a second steering angle ratio (for example, 720/45) smaller than the first steering angle ratio to computation of the port turning command angle θL*. Similarly, for realizing the characteristics shown in FIG. 5B, it suffices to apply a third steering angle ratio (for example, 720/45) to computation of the starboard turning command angle θR* in the positive steering angle region, and in the negative steering angle region, to apply a fourth steering angle ratio (for example, 720/15) greater than the third steering angle ratio to computation of the starboard turning command angle θR*.

Further, as has been described with reference to FIG. 12A and FIG. 12B, changes in the upper limit turning command angle value and the lower limit turning command angle based on speed information of the vessel 1 preferably are also responded to. Also, as in the fifth preferred embodiment, the controller 6 preferably variably sets the upper limit turning command angle values θL*max and θR*max and the lower limit turning command angle values θL*min and θR*min by being input with information of the vessel 1 from the input device 14 in advance. In this case, it suffices to limit the turning command angle θL*, θR* calculated using a calculation formula based on the steering angle δ in a range between the corresponding upper limit turning command angle value θL*max, θR*max and the lower limit turning command angle value θL*min, θR*min. Accordingly, the turning command angle θL*, θR* is capable of being set in an appropriate range.

The upper limit port turning angle value θLmax, the lower limit port turning angle value θLmin, the upper limit starboard turning angle value θRmax, and the lower limit starboard turning angle value θRmin may be stored in the memory 6M. These values are determined based on the reference angles αL and αR and the entire turning angles (for example, 30° each to the left and right of the turning center line) of the outboard motors 3L and 3R, and are therefore values containing the reference angles αL and αR. Alternatively, the information on the reference angles αL and αR and the entire turning angles of the outboard motors 3L and 3R may be stored in the memory 6M, and the controller 6 may determine, based on the information, the upper limit port turning angle value θLmax, the lower limit port turning angle value θLmin, the upper limit starboard turning angle value θRmax, and the lower limit starboard turning angle value θRmin by calculation.

Figure 17A:
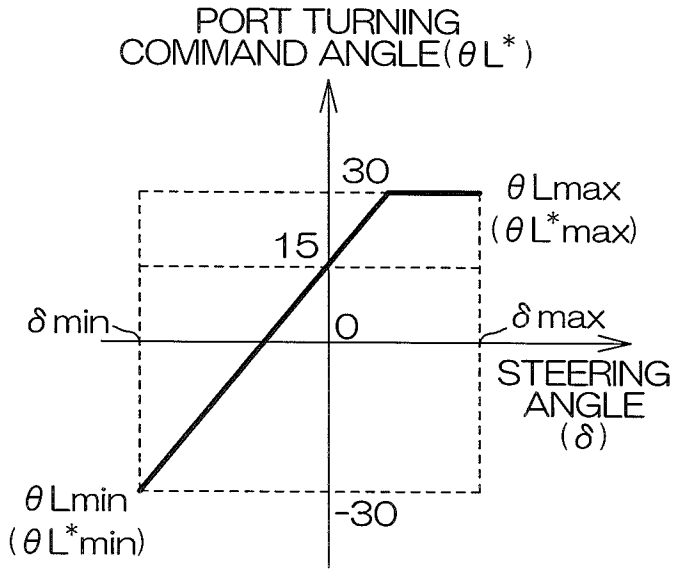
FIG. 17A and FIG. 17B are views for describing a seventh preferred embodiment of the present invention, in which examples of a turning command angle map are shown.
Figure 17B:
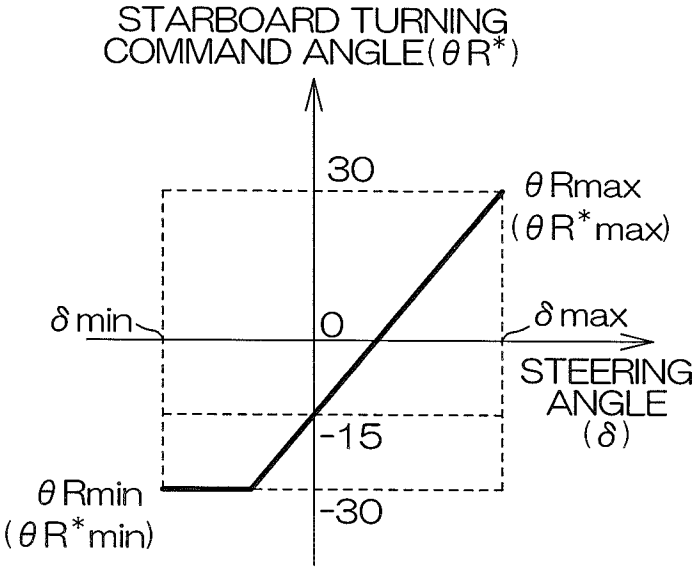

FIG. 17A and FIG. 17B are views for describing a seventh preferred embodiment of the present invention, in which examples of a turning command angle map are shown. In the first to sixth preferred embodiments described above, turning angles preferably are defined with reference to the hull center line 7, while in the present preferred embodiment, turning angles (relative turning angles) are preferably defined with reference to the turning center line 41L, 41R. That is, when the thrust action line 11L, 11R of the outboard motor 3L, 3R is parallel or substantially parallel with the corresponding turning center line 41L, 41R, the turning angle θL, θR is 0 degrees. Thus, it is not necessary to perform correction based on the reference angle αL, αR for an output of the turning angle sensor 30L, 30R.

The portside outboard motor 3L and the starboard side outboard motor 3R are respectively turnable in a range of, for example, −30 degrees to +30 degrees. That is, the lower limit turning angle value is −30 degrees in either outboard motor, and the upper limit turning angle value is +30 degrees in either outboard motor, for example.

In the port turning command angle map shown in FIG. 17A, the port turning command angle θL* is set so as to change, in response to a change in the steering angle δ, monotonously (linearly) in a range from the lower limit port turning angle value θLmin (for example, −30° to the upper limit port turning angle value θLmax (for example +30°. When the steering angle δ=0, the port turning command angle θL*=15° (=−α(L), and the thrust action line 11L of the portside outboard motor 3L is parallel or substantially parallel to the hull center line 7. When the port turning command angle θL* has reached the upper limit port turning angle value θLmax, the port turning command angle θL* does not follow a further increase in the steering angle δ (rightward steering), and is fixed at the upper limit port turning angle value θLmax.

Similarly, in the starboard turning command angle map shown in FIG. 17B, the port turning command angle θR* is set so as to change, in response to a change in the steering angle δ, monotonously (linearly) from the lower limit starboard turning angle value θRmin (for example, −30°) to the upper limit starboard turning angle value θRmax (for example, +30°). When the steering angle δ=0, the starboard turning command angle θR*=−15° (=−αR), and the thrust action line 11R of the starboard side outboard motor 3R is parallel or substantially parallel to the hull center line 7. When the starboard turning command angle θR* has reached the lower limit starboard turning angle value θRmin with a decrease in the steering angle δ (steering in the left direction), the starboard turning command angle θR* does not follow a further decrease in the steering angle δ (leftward steering), and is fixed at the lower limit starboard turning angle value θRmin.

In the case of determining turning command angles θL* and θR* with reference to the turning center lines 41L and 41R without using turning command angle maps, the controller 6 determines the port turning command angle θL* and the starboard turning command angle θR* by performing a calculation according to the following expressions (7) and (8).

$$\text{Port turning command angle } \theta L^* = (\text{Steering angle } \delta/\text{Steering angle ratio}) - \text{Port reference angle } \alpha L \quad (7)$$

$$\text{Starboard turning command angle } \theta R^* = (\text{Steering angle } \delta/\text{Steering angle ratio}) - \text{Starboard reference angle } \alpha R \quad (8)$$

For example, if the steering angle ratio is 24 (=720/30), the port reference angle αL=−15 degrees, and the starboard reference angle αR=+15 degrees, the port turning command angles θL* and the starboard turning command angle θR* are determined by the following expressions (9) and (10), respectively.

$$\text{Port turning command angle } \theta L^* = (\text{Steering angle } \delta/24) + 15 \quad (9)$$

$$\text{Starboard turning command angle } \theta R^* = (\text{Steering angle } \delta/24) - 15 \quad (10)$$

It suffices to place limitations by the lower limit turning angle value θLmin, θRmin (for example, −30 degrees) and the upper limit turning value θLmax, θRmax (for example, +30 degrees) on the port turning command angle θL* and the starboard turning command angle θR* thus determined.

Figure 18:
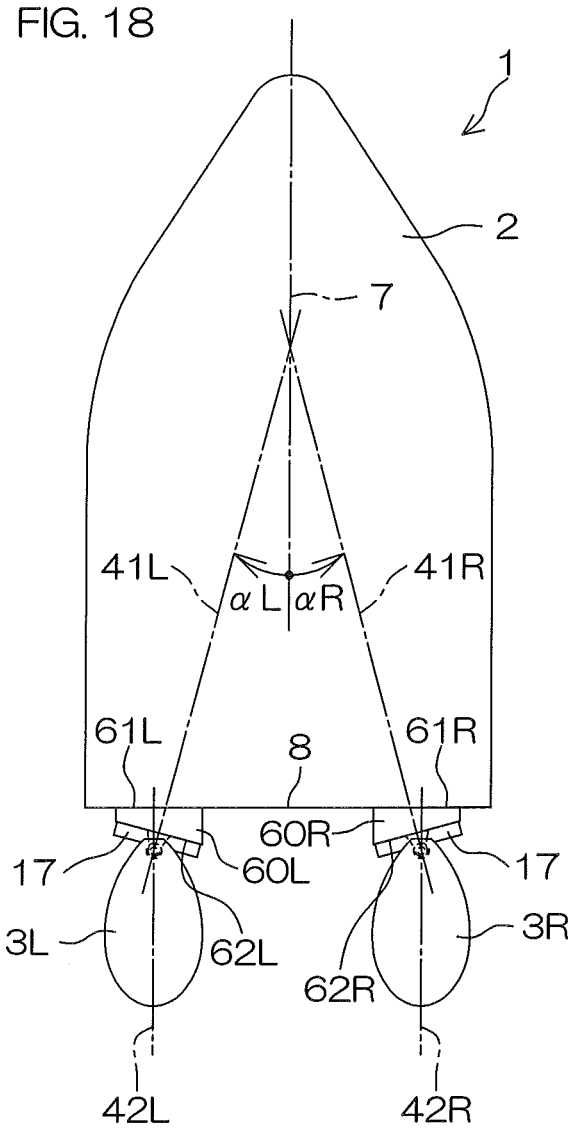
FIG. 18 is an illustrative plan view for describing an configuration of a vessel according to an eighth preferred embodiment of the present invention.

FIG. 18 is an illustrative plan view for describing a configuration of a vessel according to an eighth preferred embodiment of the present invention. In the above-described preferred embodiment, the transom board 8 of the hull 2 includes the central transom portion 8C, the portside transom portion 8L, and the starboard side transom portion 8R, wherein the portside and starboard side transom portions 8L and 8R are inclined with respect to the central transom portion 8C. In contrast thereto, the transom board 8 of the hull 2 of the present preferred embodiment is preferably provided, in a plan view, in a linear shape vertical to the hull center line 7. In the present preferred embodiment, a left attachment 60L and a right attachment 60R respectively disposed on the left side and right side with respect to the hull center line 7 are mounted on the transom board 8. Moreover, the portside outboard motor 3L and the starboard side outboard motor 3R are respectively mounted to the left attachment 60L and the right attachment 60R.

The left attachment 60L includes a hull mounting surface 61L parallel or substantially parallel to the transom board 8 and an outboard motor mounting surface 62L inclined with respect to the transom board 8. The outboard motor mounting surface 62L is inclined such that the direction of a normal line thereto intersects the hull center line 7 from the left side in front of the stern. Similarly, the right attachment 60R has a hull mounting surface 61R parallel or substantially parallel to the transom board 8 and an outboard motor mounting surface 62R inclined with respect to the transom board 8. The outboard motor mounting surface 62R is inclined such that the direction of a normal line thereto intersects the hull center line 7 from the right side in front of the stern.

The hull mounting surface 61L of the left attachment 60L is mounted on the transom board 8, and the portside outboard motor 3L is mounted on the outboard motor mounting surface 62L of the left attachment 60L. Accordingly, the turning center line 41L of the portside outboard motor 3L becomes parallel or substantially parallel with the direction of the normal line of the outboard motor mounting surface 62L, and is inclined so as to intersect the hull center line 7 from the left side in front of the stern. The angle between the port turning center line 41L and the hull center line 7 corresponds to a port reference angle $\alpha L$.

Similarly, the hull mounting surface 61R of the right attachment 60R is mounted on the transom board 8, and the starboard side outboard motor 3R is mounted on the outboard motor mounting surface 62R of the right attachment 60R. Accordingly, the turning center line 41R of the starboard side outboard motor 3R becomes parallel or substantially parallel with the direction of the normal line of the outboard motor mounting surface 62R, and is inclined so as to intersect the hull center line 7 from the right side in front of the stern. The angle between the starboard turning center line 41R and the hull center line 7 corresponds to a starboard reference angle $\alpha R$.

The configuration for turning angle control of the first to seventh preferred embodiments described above is capable of being applied to such a configuration.

Figure 19B:
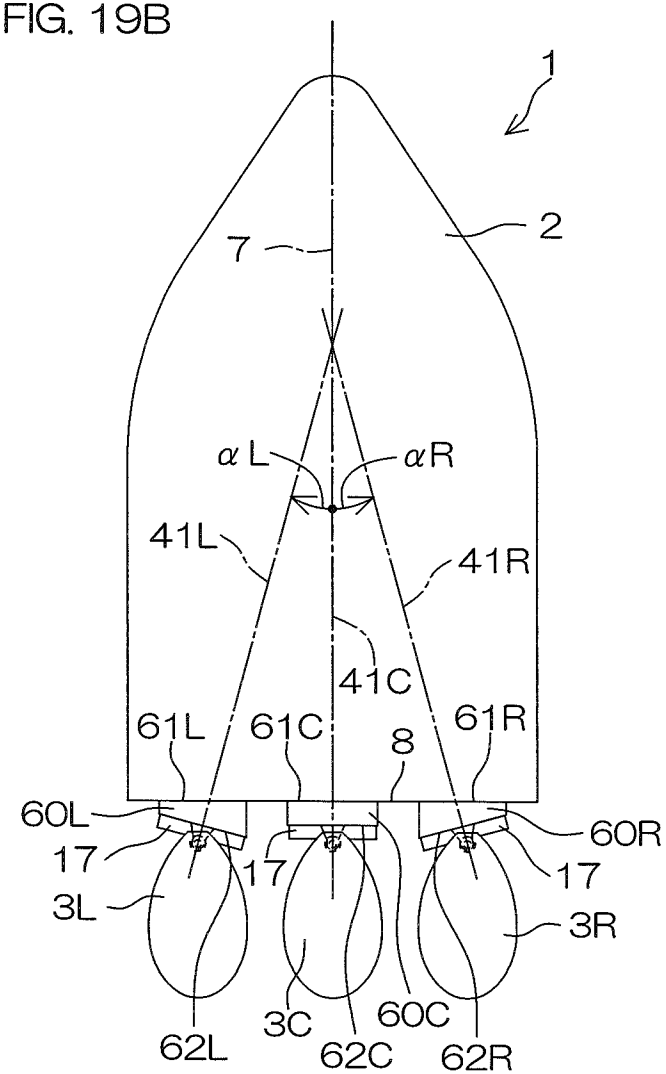
FIG. 19A and FIG. 19B are illustrative plan views for describing two configuration examples of a vessel according to a ninth preferred embodiment of the present invention.
Figure 19A:
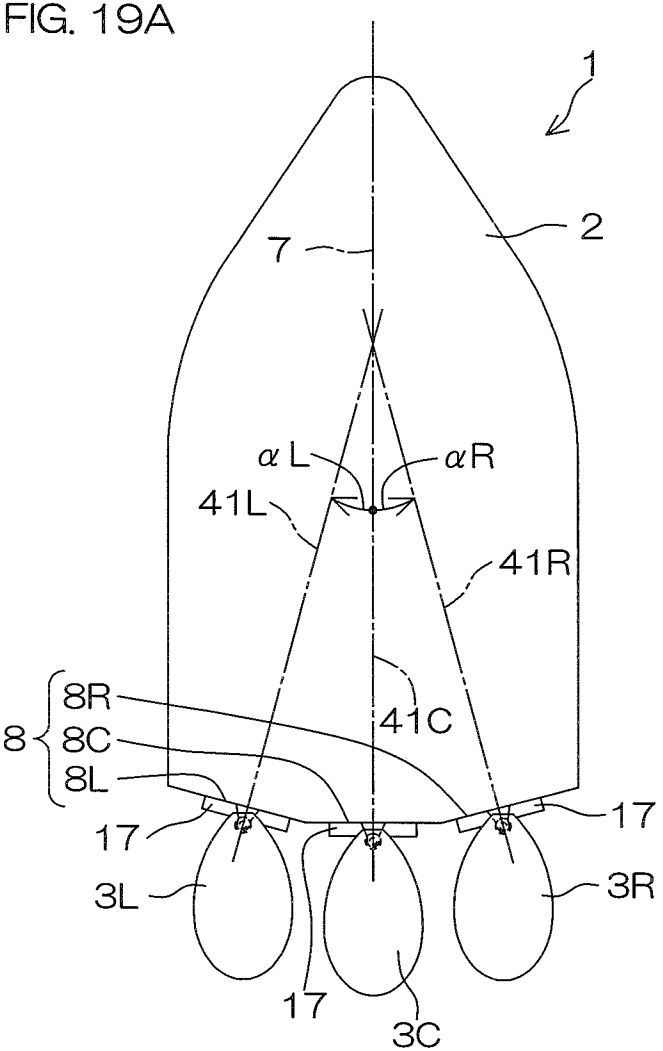

FIG. 19A and FIG. 19B are illustrative plan views for describing two configuration examples of a vessel according to a ninth preferred embodiment of the present invention.

In the vessel shown in FIG. 19A, a central outboard motor 3C is further provided between the portside outboard motor 3L and the starboard side outboard motor 3R. The hull 2 preferably has the same structure as that in the case of FIG. 1, and the transom board 8 has a central transom portion 8C vertical to the hull center line 7, a portside transom portion 8L, and a starboard side transom portion 8R, wherein the portside and starboard side transom portions 8L and 8R are inclined with respect to the hull center line 7. The portside outboard motor 3L and the starboard side outboard motor 3R are respectively mounted on the portside transom portion 8L and the starboard side transom portion 8R, and the central outboard motor 3C is mounted on the central transom portion 8C. A turning center line (hereinafter, referred to as a "central turning center line") 41C of the central outboard motor 3C is parallel or substantially parallel with the hull center line 7. That is, the central outboard motor 3C has a reference angle of zero or substantially zero. The central outboard motor 3C is an example of a central propulsion apparatus.

The vessel shown in FIG. 19B is common to the vessel shown in FIG. 19A in the point of including a portside outboard motor 3L, a starboard side outboard motor 3R, and a central outboard motor 3C. Further, similarly to the preferred embodiment shown in FIG. 18, the transom board 8 is preferably provided in a linear shape perpendicular or substantially perpendicular to the hull center line 7 in a plan view. Moreover, the portside outboard motor 3L is mounted on the transom board 8 via a left attachment 60L, and the starboard side outboard motor 3R is mounted on the transom board 8 via a right attachment 60R. The central outboard motor 3C is mounted on the transom board 8 such that the central turning center line 41C becomes parallel or substantially parallel with the hull center line 7. Thus, the central outboard motor 3C may be mounted on the transom board 8 via no attachment. In the configuration shown in FIG. 19B, the central outboard motor 3C is mounted on the transom board 8 via a central attachment 60C, and aligned in propeller position with the portside outboard motor 3L and the starboard side outboard motor 3R.

The central attachment 60C includes a hull mounting surface 61C parallel or substantially parallel to the transom board 8 and an outboard motor mounting surface 62C parallel or substantially parallel to the same transom board 8. That is, the direction of a normal line of the outboard motor mounting surface 62C is parallel or substantially parallel to the hull center line 7. The hull mounting surface 61C of the central attachment 60C is mounted on the transom board 8, and the central outboard motor 3C is mounted on the outboard motor mounting surface 62C of the central attachment 60C.

Figure 20A:
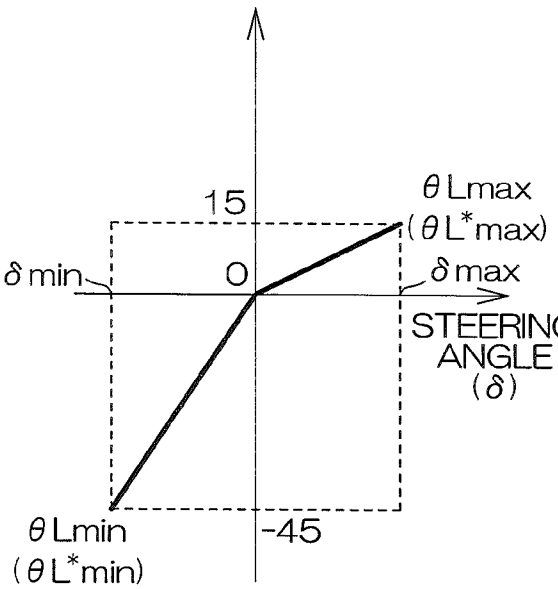
FIG. 20A, FIG. 20B, and FIG. 20C show examples of a turning command angle map in the ninth preferred embodiment of the present invention.
Figure 20B:
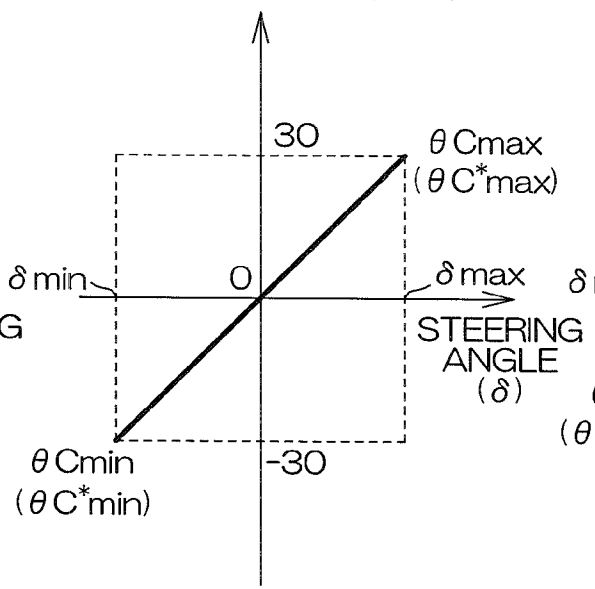
Figure 20C:
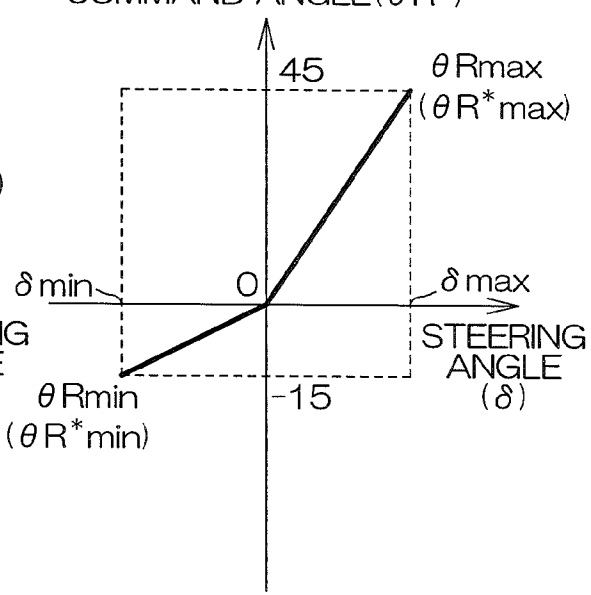

FIG. 20A, FIG. 20B, and FIG. 20C are examples of turning command angle maps in the present preferred embodiment, and correspond to the portside outboard motor 3L, the central outboard motor 3C, and the starboard side outboard motor 3R, respectively. The port turning command angle map (FIG. 20A) and the starboard turning command angle map (FIG. 20C) are the same as those in the case of the first preferred embodiment (refer to FIG. 5A and FIG. 5B). For the turning command angle map for the central outboard motor 3C (hereinafter, referred to as a "central turning command angle map") shown in FIG. 20B, the entire turning angle range is linearly made to correspond to the entire steering angle range. Specifically, the central turning command angle map is in accordance with a relationship of central turning command angle $\theta C^*$=steering angle $\delta$/steering angle ratio, in which a central turning command angle $\theta C^*=0$ is made to correspond to a steering angle $\delta=0$. For the central outboard motor 3C, a left-right mounting angle (reference angle) of which with respect to the hull 2 is zero or substantially zero, the central turning command angle map to determine a central turning command angle $\theta C^*$ without performing correction according to the left-right mounting angle is therefore used.

The entire turning angle range of the central outboard motor 3C is a range of a lower limit central turning angle value $\theta Cmin$ to an upper limit central turning angle value $\theta Cmax$. If the central outboard motor 3C is turnable by 30° each to the left and right of the central turning center line 41C, the lower limit central turning angle value $\theta Cmin=-30°$ and the upper limit central turning angle value $\theta Cmax=30°$, for example. In the present preferred embodiment, an upper limit turning command angle value of the central outboard motor 3C (upper limit central turning command angle value) $\theta C^*max$ is set equal or substantially equal to the upper limit central turning angle value $\theta Cmax$, and a lower limit turning command angle value of the central outboard motor 3C (lower limit central turning command angle value) $\theta C^*min$ is set equal or substantially equal to the lower limit central turning angle value $\theta Cmin$. Because the reference angle is zero or substantially zero, the lower limit central turning command angle value $\theta C^*min$ serving as the maximum left turning command angle and the upper limit central turning command angle value $\theta C^*max$ serving as the maximum right turning command angle are equal or substantially equal in absolute value.

Figure 21A:
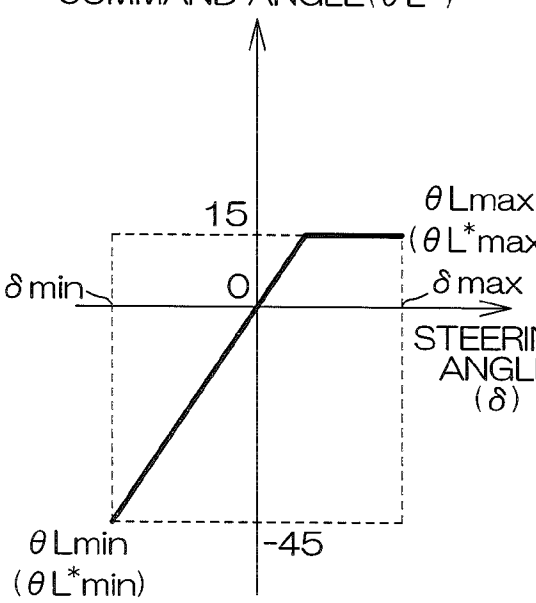
FIG. 21A, FIG. 21B, and FIG. 21C show other examples of the turning command angle map in the ninth preferred embodiment of the present invention.
Figure 21B:
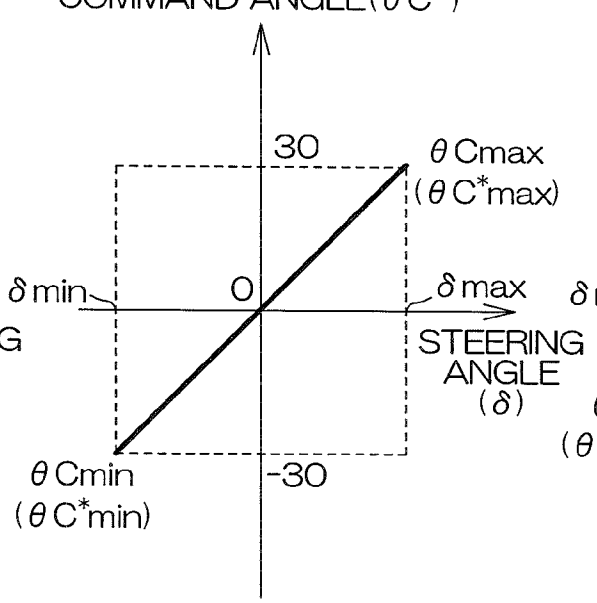
Figure 21C:
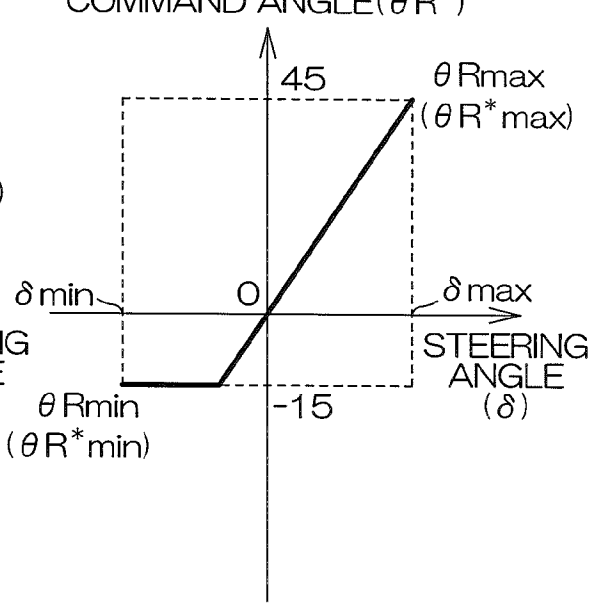

FIG. 21A, FIG. 21B, and FIG. 21C are other examples of the turning command angle maps, and correspond to the portside outboard motor 3L, the central outboard motor 3C, and the starboard side outboard motor 3R, respectively. The port turning command angle map (FIG. 21A) and the starboard turning command angle map (FIG. 21C) are the same as those in the case of the third preferred embodiment (refer to FIG. 10A and FIG. 10B). The central turning command angle map for the central outboard motor 3C shown in FIG. 21B is the same as the central turning command angle map in FIG. 20B.

Regarding the port turning command angle map and the starboard turning command angle map, the maps in curve shapes shown in the second preferred embodiment (refer to FIG. 9A and FIG. 9B) may be applied as well as other maps.

Further, as in the fourth preferred embodiment (refer to FIG. 12), in a high-speed traveling state, the central turning command angle θC* may be limited to a predetermined central turning angle range (for example, a range of $-15° \leq \theta C^* \leq 15°$) in such a manner that all outboard motors 3L, 3C, and 3R become parallel or substantially parallel, thus reducing water flow resistance.

Further, as in the fifth preferred embodiment, the upper limit turning command angle value θC*max and the lower limit turning command angle value θC*min of the central outboard motor 3C preferably are variably set based on vessel information.

Figure 22A:
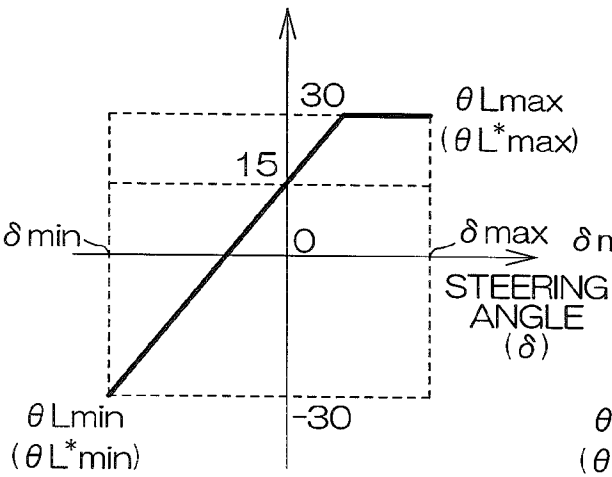
FIG. 22A, FIG. 22B, and FIG. 22C show examples of a turning command angle map when defining a turning angle with reference to a turning center line in the ninth preferred embodiment of the present invention.
Figure 22B:
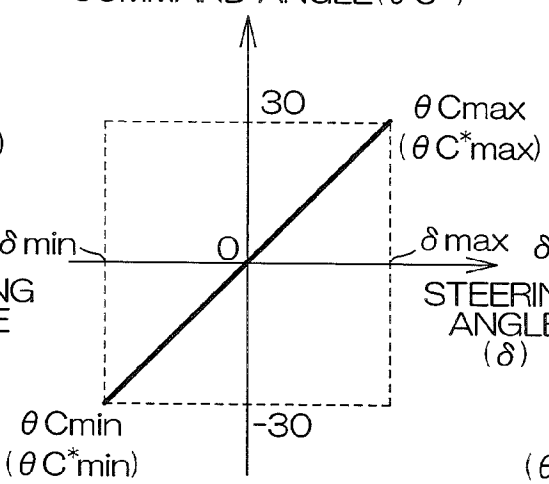
Figure 22C:
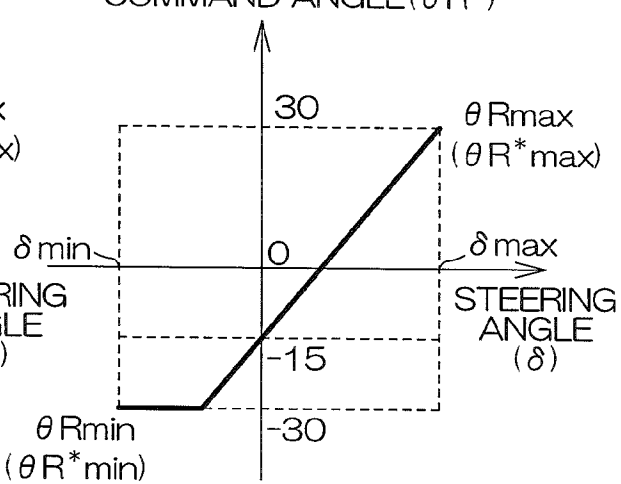

FIG. 22A, FIG. 22B, and FIG. 22C are examples of turning command angle maps when defining a turning angle with reference to a turning center line. FIG. 22A shows an example of a port turning command angle map, FIG. 22B shows an example of a central turning command angle map, and FIG. 22C shows an example of a starboard turning command angle map. The port turning command angle map and the starboard turning command angle map respectively shown in FIG. 22A and FIG. 22C are the same as the examples of the FIG. 17A and FIG. 17B described above. The central turning command angle map shown in FIG. 22B is the same as that in the case of FIG. 20B. That is, regarding the central outboard motor 3C, because the central turning center line 41C is parallel or substantially parallel with the hull center line 7, the central turning command angle θC* may as well be similarly set, either with reference to the hull center line 7 or with reference to the central turning center line 41C.

While preferred embodiments of the present invention have been described in detail above, the present invention can also be carried out instill other preferred embodiments. Specific examples of such additional preferred embodiments of the present invention are described below.

The propulsion apparatus is not limited to an outboard motor. For example, a water jet pump is an example thereof. Also, the motor defining and serving as a power source of the propulsion apparatus is not limited to an engine, and may be an electric motor.

As the turning actuator, a hydraulic cylinder may be applied, besides an electric motor. More specifically, a hydraulic cylinder that is supplied with pressure oil by an electric pump may be used as a turning actuator.

The acquisition of a steering angle may not be by a turning angle sensor. For example, when the turning actuator includes an electric motor, the turning angle can be computed based on a control signal to control the electric motor.

Two or more central outboard motors may be provided in the case of providing central outboard motors.

The present application corresponds to Japanese Patent Application No. 2013-189495 filed in the Japan Patent Office on Sep. 12, 2013, and the entire disclosure of the application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel propulsion system comprising:

a plurality of propulsion apparatuses that are turnably mounted on a stern of a hull in an inclined manner such that a turning center line intersects a hull center line;

a plurality of turning actuators configured to respectively turn the plurality of propulsion apparatuses left and right with respect to the hull;

a steering device configured to output a steering command; and a control unit configured or programmed to control the plurality of turning actuators individually according to the steering command output by the steering device; wherein the control unit is configured or programmed to include:

a storage unit configured to store a reference angle that the turning center line of each propulsion apparatus defines with respect to the hull center line, and a turning command angle computing unit configured or programmed to determine a turning command angle of each propulsion apparatus based on the steering command output by the steering device and the reference angle of each propulsion apparatus stored in the storage unit; wherein the control unit is configured or programmed to drive the corresponding turning actuator based on each turning command angle.

2. The vessel propulsion system according to claim 1, wherein the turning command angle computing unit is configured or programmed to compute the turning command angle of each propulsion apparatus mounted on the stern in the inclined manner such that characteristics in response to the steering command output by the steering device are different between left and right of a turning neutral position of the propulsion apparatus, the turning neutral position of each propulsion apparatus being a turning position of the propulsion apparatus of which thrust is along a direction parallel or substantially parallel to the hull center line.

3. The vessel propulsion system according to claim 2, wherein the turning command angle computing unit is configured or programmed to compute the turning command angle of each propulsion apparatus mounted on the stern in the inclined manner such that a turning amount with respect to the steering command output by the steering device is different between left and right of the turning neutral position.

4. The vessel propulsion system according to claim 2, wherein the turning command angle computing unit is configured or programmed to compute the turning command angle of each propulsion apparatus mounted on the stern in the inclined manner such that a rate of change in a turning amount with respect to the steering command output by the steering device is different between left and right of the turning neutral position.

5. The vessel propulsion system according to claim 2, wherein the turning command angle computing unit is configured or programmed to compute the turning command angle of each propulsion apparatus mounted on the stern in the inclined manner such that a maximum right turning command angle that is a maximum turning command angle in a right direction from the turning neutral position and a maximum left turning command angle that is a maximum turning command angle in a left direction from the turning neutral position are different.

6. The vessel propulsion system according to claim 1, wherein the turning command angle computing unit is configured or programmed to, when a turning angle of each propulsion apparatus has reached an upper limit turning angle in one direction, keep the turning command angle of the propulsion apparatus unchanged even if the steering device outputs the steering command for further steering in the one direction.

7. The vessel propulsion system according to claim 6, wherein the steering device includes an operating member configured to be operated left and right by an operator; and the turning command angle computing unit is configured or programmed to, when an operation amount in one direction of the operating member is not less than a predetermined operation amount corresponding to the upper limit turning angle of each propulsion apparatus, keep the turning command angle of the propulsion apparatus unchanged.

8. The vessel propulsion system according to claim 1, wherein the steering device includes an operating member configured to be able to be operated unlimitedly left and right; and the turning command angle computing unit is configured or programmed to:

keep a turning command angle of a first propulsion apparatus of the plurality of propulsion apparatuses unchanged when an operation amount in one direction of the operating member becomes not less than a first operation amount; and keep a turning command angle of a second propulsion apparatus disposed on an inner side in terms of a turning direction of the hull than the first propulsion apparatus of the plurality of propulsion apparatuses unchanged when the operation amount in one direction of the operating member becomes not less than a second operation amount greater than the first operation amount.

9. The vessel propulsion system according to claim 1, wherein the control unit is configured or programmed to, when a turning angle of each propulsion apparatus has reached an upper limit turning angle in one direction, stop energy supply to the corresponding turning actuator and keep energy supply to the turning actuator stopped even if the steering device outputs the steering command for further steering in the one direction.

10. The vessel propulsion system according to claim 9, wherein the steering device includes an operating member that is operated left and right by an operator; and the control unit is configured or programmed to, when an operation amount in one direction of the operating member is not less than a predetermined operation amount corresponding to the upper limit turning angle of each propulsion apparatus, stop energy supply to the turning actuator corresponding to the propulsion apparatus.

11. The vessel propulsion system according to claim 1, wherein the steering device includes an operating member configured to be able to be operated unlimitedly left and right; and the control unit is configured or programmed to:

stop energy supply to the turning actuator corresponding to a first propulsion apparatus of the plurality of propulsion apparatuses when an operation amount in one direction of the operating member becomes not less than a first operation amount; and stop energy supply to the turning actuator corresponding to a second propulsion apparatus disposed on an inner side in terms of a turning direction of the hull than the first propulsion apparatus of the plurality of propulsion apparatuses when the operation amount in one direction of the operating member becomes not less than a second operation amount greater than the first operation amount.

12. The vessel propulsion system according to claim 6, further comprising an upper limit turning angle setting unit configured to variably set the upper limit turning angle according to a vessel state.

13. The vessel propulsion system according to claim 8, further comprising an operation amount threshold setting unit configured to variably set the first operation amount according to a vessel state.

14. The vessel propulsion system according to claim 1, wherein the turning command angle computing unit is configured or programmed to determine the turning command angle of each propulsion apparatus using a turning command angle map according to the reference angle of the propulsion apparatus; and the storage unit has stored therein the turning command angle map in which the reference angle is intrinsically present.

15. The vessel propulsion system according to claim 1, wherein the turning command angle computing unit is configured or programmed to, when the steering device outputs a neutral steering command representing a neutral position, determine the turning command angle of each propulsion apparatus such that each propulsion apparatus becomes parallel or substantially parallel in direction to the hull center line.

16. The vessel propulsion system according to claim 1, wherein the plurality of propulsion apparatuses that are mounted on the stern in the inclined manner include:

a right propulsion apparatus that is disposed on a right side with respect to the hull center line, and mounted on the stern in an inclined manner such that a turning center line intersects the hull center line from the right side; and a left propulsion apparatus that is disposed on a left side with respect to the hull center line, and mounted on the stern in an inclined manner such that a turning center line intersects the hull center line from the left side.

17. The vessel propulsion system according to claim 16, further comprising a central propulsion apparatus that is disposed between the right propulsion apparatus and the left propulsion apparatus, and mounted on the stern of the hull with a turning center line set parallel or substantially parallel to the hull center line.

18. The vessel propulsion system according to claim 17, wherein the turning command angle computing unit is configured or programmed to, according to the steering command output by the steering device, determine a turning command angle of the central propulsion apparatus without performing correction according to a leftward or rightward mounting angle of the central propulsion apparatus with respect to the stern of the hull.

19. The vessel propulsion system according to claim 1, wherein each propulsion apparatus is an outboard motor including a front portion opposed to the stern and a wide portion that is disposed further to a rear than the front portion and wider than the front portion.

20. A vessel comprising:

a hull; and the vessel propulsion system according to claim 1 attached to the hull.

* * * * *